US005112730A

United States Patent [19]

Ohkawa et al.

[11] Patent Number: 5,112,730

[45] Date of Patent: May 12, 1992

[54] SILVER HALIDE COLOR PHOTOGRAPHIC MATERIAL COMPRISING A YELLOW-COLORED CYAN COUPLER

[75] Inventors: Atsuhiro Ohkawa; Takayoshi Kamio; Masuzi Motoki; Keiji Mihayashi, all of Kanagawa, Japan

[73] Assignee: Fuji Photo Film Co., Ltd., Kanagawa, Japan

[21] Appl. No.: 622,702

[22] Filed: Dec. 5, 1990

[30] Foreign Application Priority Data

Dec. 6, 1969 [JP] Japan ..... 1-316951

[51] Int. Cl.[5] ..... G03C 7/333; G03C 7/34

[52] U.S. Cl. ..... 430/553; 430/226; 430/359; 430/549; 430/562

[58] Field of Search ..... 430/359, 549, 552, 553, 430/562, 226

[56] References Cited

U.S. PATENT DOCUMENTS

| | | | |
|---|---|---|---|
| 4,294,900 | 10/1981 | Aono | 430/7 |
| 4,507,380 | 3/1985 | Naito et al. | 430/203 |
| 4,690,889 | 9/1987 | Saito et al. | 430/552 |
| 4,883,746 | 11/1989 | Shimada et al. | 430/504 |

FOREIGN PATENT DOCUMENTS

| | | | |
|---|---|---|---|
| 754495 | 3/1967 | Canada | 430/226 |
| 1258266 | 1/1968 | Fed. Rep. of Germany | 430/359 |
| 738138 | 10/1955 | United Kingdom | 430/553 |

*Primary Examiner*—Lee C. Wright

*Attorney, Agent, or Firm*—Sughrue, Mion, Zinn Macpeak & Seas

[57] ABSTRACT

A silver halide color photographic material comprises a support having thereon at least one silver halide emulsion layer and at least one cyan coupler which can release a water-soluble compound residual group which contains a 2-acyaminophenylazo group or 2-sulfonamidophenylazo group via a coupling reaction with an oxidation product of a primary aromatic amine developing agent.

10 Claims, No Drawings

SILVER HALIDE COLOR PHOTOGRAPHIC MATERIAL COMPRISING A YELLOW-COLORED CYAN COUPLER

FIELD OF THE INVENTION

This invention relates to silver halide color photographic materials which have excellent color reproduction and colored image fastness.

BACKGROUND OF THE INVENTION

Color reproduction using a subtractive color method is used in normal silver halide photographic materials, and with this method yellow, magenta and cyan dye images which have a complimentary color relationship are used to reproduce blue, green and red colors.

A cyan dye is formed by a coupling reaction between a cyan dye forming compound (referred to hereinafter as a cyan coupler) and an oxidation product of a primary aromatic amine developing agent which is included in the developer in the color development process, and the cyan dye preferably absorbs only light in the red region and provides a brilliant hue.

However, the phenol type and naphthol type indoaniline dyes which are widely used as cyan dyes at the present time have unwanted absorption in the blue absorption band and in the green absorption band. Hence, in color negative films, magenta colored cyan couplers are being used with a view to correcting the unwanted absorption of the cyan dye in the green absorption band, and various compounds have been proposed for this purpose.

On the other hand, little research has been done in connection with yellow colored couplers which correct the unwanted absorption of the cyan dyes in the blue absorption band, and this has been disclosed only in JP-A-61-221748 and JP-A-59-214853. (The term "JP-A" as used herein means an "unexamined published Japanese patent application".) Furthermore, the disclosed yellow colored cyan couplers are inadequate in terms of their coupling activity and the hue of the yellow dye.

SUMMARY OF THE INVENTION

An object of the present invention is to provide silver halide color photographic materials which provide both excellent color reproduction and a colored image which has excellent light fastness.

This object of the invention has been realized by means of a silver halide color photographic material comprising a support having thereon at least one silver halide emulsion layer and at least one cyan coupler which can release a water soluble compound residual group which contains a 2-acylaminophenylazo group or 2-sulfonamidophenylazo group via a coupling reaction with an oxidation product of a primary aromatic amine developing agent.

DETAILED DESCRIPTION OF THE INVENTION

The cyan couplers of the present invention are those which (1) release water-soluble compounds which contain a 2-acylamino phenylazo group or 2-sulfonamidophenylazo group via a coupling reaction with the oxidation product of a primary aromatic amine, and (2) have a peak absorption in the visible region between 400 nm and 500 nm (hereinafter "yellow colored cyan couplers"). The yellow colored cyan couplers of the present invention are described in detail below.

By using yellow colored cyan couplers of the present invention it is possible to achieve ideal color reproduction with no fluctuation in the unwanted absorption on the short wavelength side, and especially in the yellow, which accompanies fluctuation in the cyan density.

Moreover, by using cyan couplers represented by the general formula (C) defined hereafter conjointly with the yellow colored cyan couplers of the present invention, it has been possible to provide a photographic light-sensitive material with which the characteristics of both types of couplers are adequately realized and with which there is a great improvement in the fastness of the cyan image, color reproduction and color forming properties. The yellow colored cyan couplers of the present invention are preferably represented by the general formula (I):

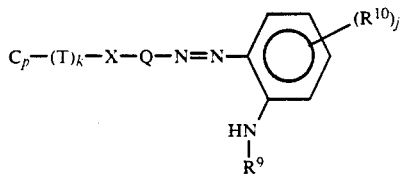

(I)

wherein Cp represents a cyan coupler residue (with T bonded to the coupling position), T represents a timing group, k represents an integer of 0 or 1, X represents a divalent linking group which contains N, O or S which is bonded to $(T)_k$ by this atom and which is joined to Q, Q represents an arylene group or a divalent heterocyclic group, $R^9$ represents an acyl group or a sulfonyl group, $R^{10}$ represents a substitutable group and j represents an integer of from 0 to 4. Moreover, when j is an integer of 2 or more, the $R^{10}$ groups may be the same or different. At least one of the groups T, X, Q, $R^9$ or $R^{10}$ contains a water soluble group (for example, hydroxyl, carboxyl, sulfo, phospho, phosphino, hydroxysulfonyloxy, amino, ammoniumyl).

The compounds represented by general formula (I) are described hereinafter in more detail.

The cyan coupler residual group represented by Cp may be a known cyan coupler residual group, for example, a phenol type or naphthyl type coupler residual group.

Preferred examples of Cp include the coupler residual groups represented by the following general formulae (Cp-1), (Cp-2) or (Cp-3). These couplers have a high coupling rate and are desirable.

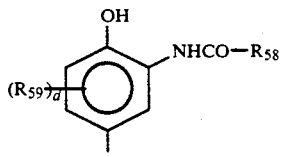

(Cp-1)

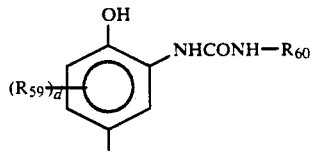

(Cp-2)

-continued (Cp-3)

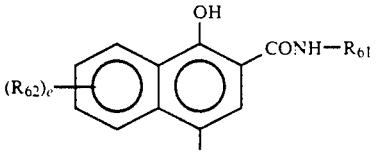

The free bond at the coupling position in the above formulae indicates the position at which the coupling leaving group is bonded.

In those cases where $R_{58}$, $R_{59}$, $R_{60}$, $R_{61}$ or $R_{62}$ in these formulae contains a nondiffusible group, this group is selected in such a way that the total number of carbon atoms is from 8 to 40, and preferably from 10 to 30, and in other cases the total number of carbon atoms is preferably not more than 15. In the case of bis-type, telomeric type of polymeric type couplers any of the above described substituents may be a divalent group for connecting the repeating units. In this case the range of the number of carbon atoms may be outside the range indicated above.

The groups $R_{58}$ to $R_{62}$, d and e are described hereinafter in more detail, where $R_{41}$ represents an aliphatic group, an aromatic group or a heterocyclic group, $R_{42}$ represents an aromatic group or a heterocyclic group, and $R_{43}$, $R_{44}$ and $R_{45}$ represent independently a hydrogen atom, an aliphatic group, an aromatic group or a heterocyclic group.

$R_{58}$ represents a group which has the same significance as $R_{41}$.

$R_{59}$ represents a group which has the same significance as $R_{41}$, an $R_{41}CON(R_{43})$— group, an $R_{41}OCON(R_{43})$— group, an $R_{41}SO_2N(R_{43})$— group, an —$R_{43}NCON(R_{44})(R_{45})$— group, an $R_{41}O$- group, an $R_{41}S$-group, a halogen atom or an $R_{41}N(R_{43})$— group; and d represents an integer of from 0 to 3.

When d is 2 or 3, the plurality of $R_{59}$ groups may be the same or different substituents. Furthermore, these $R_{59}$ groups may be joined with a divalent group to form a ring structure. Typical examples of divalent groups for forming a ring structure are indicated below:

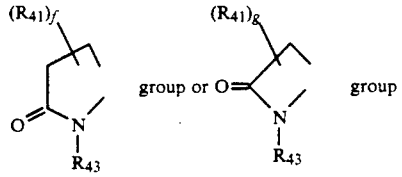

wherein f represents an integer of from 0 to 4 and g represents an integer of from 0 to 2.

$R_{60}$ and $R_{61}$ represent groups which have the same significance as $R_{41}$.

$R_{62}$ represents a group which has the same significance as $R_{41}$, an $R_{41}CONH$- group, a $R_{41}OCONH$-group, an $R_{41}SO_2NH$-group, an $R_{43}NCON(R_{44})(R_{45})$— group, an $R_{43}NSO_2N(R_{44})(R_{45})$— group, and $R_{43}O$- group, an $R_{41}S$- group, a halogen atom or an $R_{41}N(R_{43})$— group, e represents represents an integer of value from 0 to 4. When there is a plurality of the groups $R_{62}$, these groups may be the same or different.

In the descriptions above, an "aliphatic group" signifies a saturated or unsaturated, chain like or cyclic, straight chain or branched, substituted or unsubstituted aliphatic hydrocarbon group having from 1 to 32, and preferably from 1 to 22, carbon atoms. Typical examples include methyl, ethyl, propyl, iso-propyl, butyl, tert-butyl, iso-butyl, tert-amyl, hexyl, cyclohexyl, 2-ethylhexyl, octyl, 1,1,3,3-tetramethylbutyl, decyl, dodecyl, hexadecyl and octadecyl groups.

The term "aromatic group" as used herein means a substituted or unsubstituted phenyl group or a substituted or unsubstituted naphthyl group, which preferably has from 6 to 20 carbon atoms.

The term "heterocyclic group" as used herein means preferably 3- to 8-membered substituted or unsubstituted heterocyclic group with a hetero atom selected from the nitrogen, oxygen and sulfur atoms and which has from 1 to 20, and preferably from 1 to 7, carbon atoms. Typical examples of heterocyclic groups include the 2-pyridyl, 2-thienyl, 2-furyl, 1-imidazolyl, 1-indolyl, phthalimido, 1,3,4-thiadiazol-2-yl, 2-quinolyl, 2,4-dioxo-1,3-imidazolidin-5-yl, 2,4-dioxo-1,3-imidazolidin-3-yl, succinimido, 1,2,4-triazol-2-yl and 1-pyrazolyl groups.

Typical examples of the substituents in those cases where the aforementioned aliphatic hydrocarbon groups, aromatic groups and heterocyclic groups have substituents include a halogen atom, $R_{47}O$-, $R_{46}S$-, $R_{47}CON(R_{48})$—, $R_{47}NCO(R_{48})$—, $R_{46}OCON(R_{47})$—, $R_{46}SO_2N(R_{47})$—, $R_{47}NSO_2(R_{48})$—, $R_{46}SO_2$—, $R_{47}OCO$—, $R_{47}NCON(R_{47})(R_{48})$—, a group of the same significance as $R_{46}$, a group of the same significance as $R_{46}$.

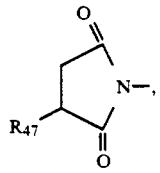

$R_{46}COO$-, $R_{47}OSO_2$-, a cyano group and a nitro group. Here, $R_{46}$ represents an aliphatic group, an aromatic group or a heterocyclic group, and $R_{47}$, $R_{48}$ and $R_{49}$ each represents an aliphatic group, an aromatic group, a heterocyclic group or a hydrogen atom. The significance of the terms aliphatic group, aromatic group and heterocyclic group is the same as that defined above.

The preferred groups for $R_{58}$ to $R_{62}$. and preferred values for d and e, are described below.

$R_{58}$ is preferably an aliphatic group or an aromatic group. In general formula (Cp-1), $R_{59}$ is preferably a chlorine atom, an aliphatic group or an $R_{41}CONH$-group; d is preferably 1 or 2; and $R_{60}$ is preferably an aromatic group. In general formula (Cp-2), $R_{59}$ is preferably an $R_{41}CONH$- group; d is preferably 1; and $R_{61}$ is preferably an aliphatic group or an aromatic group. In general formula (Cp-3), e is preferably 0 or 1; $R_{62}$ is preferably an $R_{41}OCONH$- group, an $R_{41}CONH$- group or an $R_{41}SO_2NH$- group, and these substituents are preferably in the 5-position of the naphthol ring.

Typical examples of $R_{58}$ to $R_{62}$ are described below.

Examples of $R_{58}$ include 2-chlorophenyl, pentafluorophenyl, heptafluoropropyl, 1-(2,4-di-tert-amylphenoxy)propyl, 3-(2,4-di-tert-amylphenoxy)propyl, 2,4-di-tert-amylmethyl and furyl.

Examples of $R_{59}$ include chlorine, methyl, ethyl, propyl, butyl, iso-propyl, 2-(2,4-di-tert-amylphenoxy)-butanamido, 2-(2,4-di-tert-amylphenoxy)hexanamido, 2-(2,4-di-tert-octylphenoxy)octanamido, 2-(2-chlorophenoxy)tetradecanamido, 2-{4-(4-hydroxyphenylsulfonyl)phenoxy}tetradecanamido and 2-{2-(2,4-di-tert-amylphenoxyacetamido)-phenoxy}butanamido.

Examples of $R_{60}$ include 4-cyanophenyl, 2-cyanophenyl, 4-butylsulfonylphenyl, 4-propylsulfonylphenyl, 4-chloro-3-cyanophenyl, 4-ethoxycarbonylphenyl and 3,4-dichlorophenyl.

Examples of $R_{61}$ include dodecyl, hexadecyl, cyclohexyl, 3-(2,4-di-tert-amylphenoxy)propyl, 4-(2,4-di-tert-amylphenoxy)butyl, 3-dodecyloxypropyl, tert-butyl, 2-methoxy-5-dodecyloxycarbonylphenyl and 1-naphthyl.

Examples of $R_{62}$ include iso-butyloxycarbonylamino, ethoxycarbonylamino, phenylsulfonylamino, methanesulfonamido, benzamido, trifluoroacetamido, 3-phenylureido, butoxycarbonylamino and acetamido.

Of the coupler residual groups represented by the general formulae (Cp-1) to (Cp-3), those represented by (Cp-1) and (Cp-3) are preferred, and those represented by (Cp-3) are the most desirable.

The timing group represented by T is a group of which the bond with X is cleaved after the bond with Cp has been cleaved by a coupling reaction between the coupler represented by general formula (I) and the oxidation product of a primary aromatic amine developing agent, and it is used for various purposes, for example with a view to controlling the coupling reactivity, stabilizing the coupler and adjusting the release timing of X and the remainder of the molecule. Some examples of known timing groups are described below. (1) Groups utilizing Hemi-acetal Cleavage Reaction Examples of these groups are disclosed in U.S. Pat. No. 4,146,396, JP-A-60-249148 and JP-A-60-249149, and these groups can be represented by the general formula indicated below, where * indicates the position which is bonded to the left hand side in general formula (I) and ** indicates the position which is bonded to the right hand side in general formula (I).

(T-1)

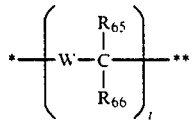

In formula (T-1), W represents an oxygen atom, a sulfur atom or an

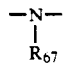

group, $R_{65}$ and $R_{66}$ each represents a hydrogen atom or a substituent, $R_{67}$ represents a substituent and t represents 1 or 2. When t is 2, the two

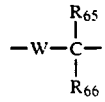

groups may be the same or different. Typical examples of $R_{65}$ and $R_{66}$, when they represent substituents, and $R_{67}$, include $R_{69}$, $R_{69}CO$-, $R_{69}SO_2$-,

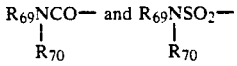

groups wherein $R_{69}$ has the same significance as $R_{51}$ described above, and $R_{70}$ is a hydrogen atom or a group which has the same significance as $R_{43}$. Cases in which $R_{65}$, $R_{66}$ and $R_{67}$ respectively represent divalent groups which are joined together to form a ring structure are also included. Actual examples of groups represented by the general formula (T-1) are indicated below.

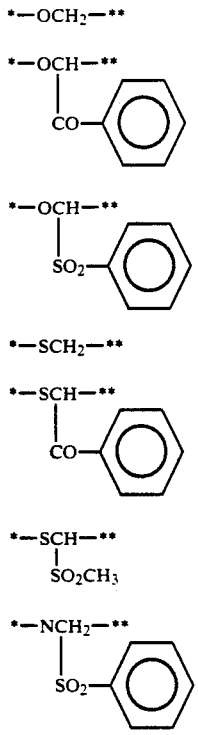

-continued

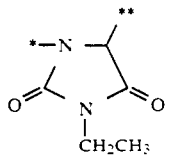

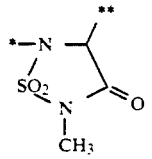

(2) Groups with which a Cleavage Reaction Occurs via an Intramolecular Nucleophilic Substitution Reaction Examples of these timing groups are disclosed in U.S. Pat. No. 4,248,962, and can be represented by the following general formula:

*-Nu-Link-E-** (T-2)

In this formula, * indicates the position which is bonded on the left hand side in general formula (I) and  indicates the position which is bonded on the right hand side in general formula (I); Nu represents a nucleophilic group, with oxygen or sulfur, for example, as the nucleophilic species; E represents an electrophilic group, being a group which is the subject of a nucleophilic attack by Nu so that the bond marked  can be cleaved; and Link is a linking group which enables Nu and E to have a steric arrangement such that an intramolecular nucleophilic substitution reaction can occur.

Actual examples of the groups represented by general formula (T-2) are indicated below.

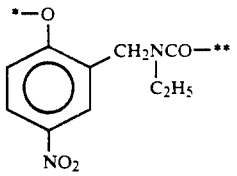

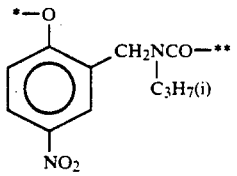

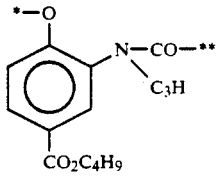

-continued

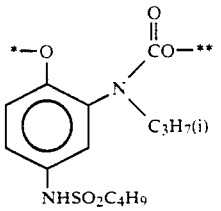

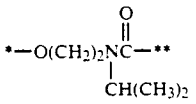

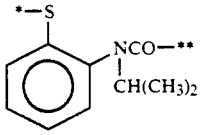

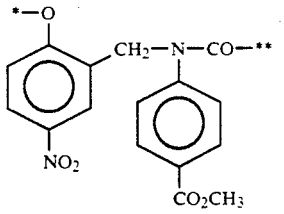

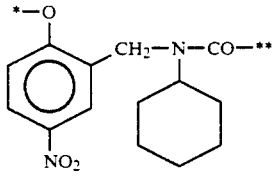

(3) Groups in which a Cleavage Reaction Occurs via an Electron Transfer Reaction along a Conjugated System Examples of these groups can be represented by the general formula (T-3) indicated below as disclosed in U.S. Pat. Nos. 4,409,323 and 4,421,845.

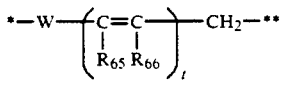

(T-3)

In formula (T-3), *, **, W, $R_{65}$, $R_{66}$ and t all have the same significance as described in connection with general formula (T-1). Actual examples of these groups are indicated below.

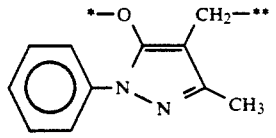

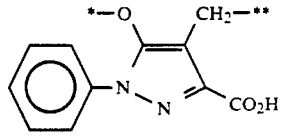

-continued

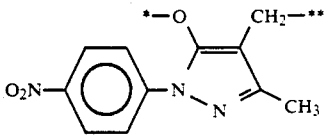

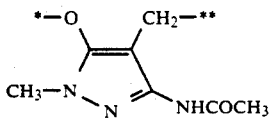

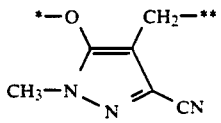

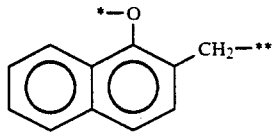

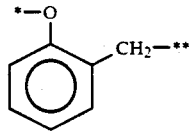

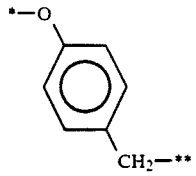

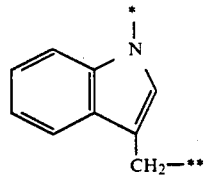

(4) Groups utilizing Cleavage Reaction due to Ester Hydrolysis

Examples of these linking groups are disclosed in West German Patent Laid Open No. 2,626,315 as indicated below by formulae (T-4) and (T-5). In these formulae, * and ** have the same significance as described in connection with general formula (T-1).

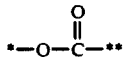

(T-4)

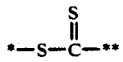

(T-5)

(5) Groups utilizing Iminoketal Cleavage Reaction

Examples of these linking groups are disclosed in U.S. Pat. No. 4,546,073, and are represented by the general formula indicated below.

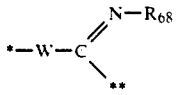

(T-6)

In formula (T-6), *, ** and W have the same significance as described in connection with general formula (T-1), and $R_{68}$ has the same significance as $R_{67}$. Actual examples of groups represented by general formula (T-6) are indicated below.

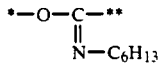

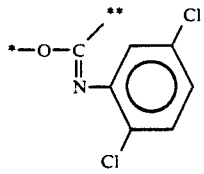

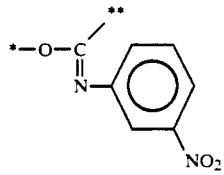

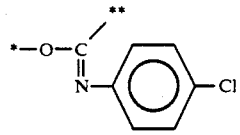

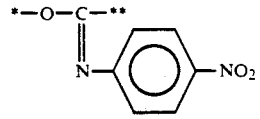

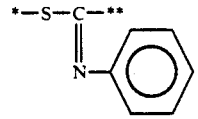

Of the timing groups described above, those represented by the general formulae (T-1) to (T-3) are preferred in the present invention. Moreover, k is an integer of value 0 or 1, and those cases where k is 0, that is, Cp and X are bonded directly to one another, are preferred.

X is a divalent linking group which is bonded to $(T)_k$ by N, O or S, and can be —O—, —S—,

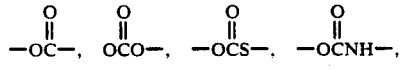

$—OSO_2—$, $—OSO_2NH—$ or a heterocyclic group which is bonded with $(T)_k$ by N (for example, a group derived from pyrrolidine, piperidine, morpholine, piperazine, pyrrole, pyrazole, imidazole, 1,2,4-triazole, benzotriazole, succinimide, phthalimide, oxazolidin-2,3-dione, imidazolidin-2,4-dione and 1,2,4-triazolidin-3,5-dione), or can be a composite linking group in which the above groups are combined with an alkylene group (for example, methylene, ethylene, propylene), a cycloalkylene group (for example 1,4-cyclohexylene), an arylene group (for example, o-phenylene, p-phenylene), a divalent heterocyclic group (for example, a group derived from pyridine or thiophene), —CO—, —$SO_2$—, —COO—, —CONH—, $SO_2NH$—, —$SO_2O$—, —NHCO—, —$NHSO_2$—, —NHCONH—, —$NHSO_2NH$— or —NHCOO—, for example. X is most desirably represented by general formula (II).

$$* \text{-}X_1\text{-}(L\text{-}X_2)_m\text{-}** \qquad \text{(II)}$$

In general formula (II), * signifies the position which is bonded to $(T)_k$, ** signifies the position which is bonded to Q, $X_1$ represents —O— or —S—, L represents an alkylene group, $X_2$ represents a single bond, —O—, —S—, —CO—, —$SO_2$—,

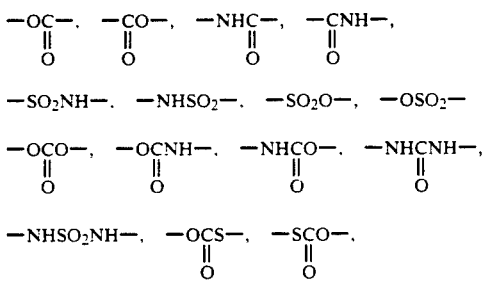

—$OSO_2NH$— or —$NHSO_2O$—, and m represents an integer of from 0 to 3. The total number of carbon atoms (referred to hereinafter as the C-number) in X is preferably from 0 to 12, and most preferably from 0 to 8.

Q represents an arylidene group or a divalent heterocyclic group. When Q is an arylidene group it may have a condensed ring and it may have substituents (for example, a halogen atom, hydroxyl, carboxyl, sulfo, nitro, cyano, amino, ammonium, phospho, phosphino, alkyl, cycloalkyl, aryl, carboxamido, sulfonamido, alkoxy, aryloxy, acyl, sulfonyl, carbamoyl, sulfamoyl), and the C-number is preferably from 6 to 15, and most desirably from 6 to 10. When Q is a divalent heterocyclic group, the heterocyclic group is a 3- to 8-membered, and preferably 5- to 7-membered, single or condensed ring heterocyclic group which contains at least one heteroatom selected from N, 0, S, P, Se and Te atoms (for example, a group derived from pyridine, thiophene, furan, pyrrole, pyrazole, imidazole, thiazole, oxazole, benzothiazole, benzoxazole, benzofuran, benzothiophene, 1,3,4-thiadiazole, indole or quinoline), and it may have substituent groups (same substituents as when Q is an arylene group), and the C number is preferably from 2 to 15, and most desirably from 2 to 10.

In practice, $R^9$ is an acyl group which can be represented by the general formula (III) or a sulfonyl group which can be represented by the general formula (IV).

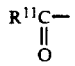

(III)

-continued $$R^{11}SO_2\text{—} \qquad \text{(IV)}$$

When $R^{11}$ is an alkyl group, it may be either a straight chain or branched chain alkyl group, it may contain unsaturated bonds, and it may have substituents (for example, a halogen atom, hydroxyl, carboxyl, sulfo, phosphono, phosphino, cyano, alkoxy, aryl, alkoxycarbonyl, amino, ammoniumyl, acyl, carboxamido, sulfonamido, carbamoyl, sulfamoyl, sulfonyl).

When $R^{11}$ is a cycloalkyl group, it is a 3- to 8-membered cycloalkyl group, and may contain a crosslinking group, an unsaturated bond and a substituent (the same substituent as in the case where Ru is an alkyl group).

When $R^{11}$ is an aryl group, it may be a condensed ring and contain a substituent (for example, alkyl and cycloalkyl, in addition to the substituent when $R^{11}$ is an alkyl group.

When $R^{11}$ is a heterocyclic group, it is a 3- to 8-membered (and preferably 5- to 7-membered) single ring or condensed ring heterocyclic ring which contains at least one hetero-atom selected from N, S, O, P, Se and Te (for example, imidazolyl, thienyl, pyrazolyl, thiazolyl, pyridyl, quinolinyl), and it may have a substituent (the same substituent as in the case where $R^{11}$ is an aryl group).

With regard to the substituents when $R^{11}$ is a heterocyclic group, the carboxyl group may be a carboxylate group, the sulfo group may be a sulfonate group, the phosphino group may be a phosphinate group and the phospho group may be a phosphonate group, and in such a case the counter ion can be, for example, $Li^+$, $Na^+$, $K^+$ or ammonium.

$R^{11}$ is preferably an alkyl group having from 1 to 10 carbon atoms (for example, methyl, carboxymethyl, sulfoethyl, cyanoethyl), a cycloalkyl group having from 5 to 8 carbon atoms (for example, cyclohexyl, 2-carboxycyclohexyl) or an aryl group having from 6 to 10 carbon atoms (for example phenyl, 1-naphthyl, 4-sulfophenyl), and it is most desirably an alkyl group having from 1 to 3 or an aryl group having 6 carbon atoms.

$R^{10}$ is a substituent group, and preferably an electron donating group, and most desirably —$NR^{12}R^{13}$ or —$OR^{14}$. The 4-position is the preferred substitution position. $R^{12}$, $R^{13}$ and $R^{14}$ each represents a hydrogen atom, an alkyl group, a cycloalkyl group, an aryl group or a heterocyclic group, and these groups are defined the same as for $R^{11}$. Furthermore, a ring can be formed between $R^{12}$ and $R^{13}$, and cases in which an alicyclic ring is formed as a nitrogen containing heterocyclic ring are preferred.

Moreover, j represents an integer of from 0 to 4, preferably 1 or 2, and most preferably 1.

Specific examples of Cp, X, Q and

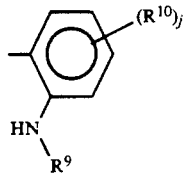

in general formula (II) are indicated below. (Specific examples of T have been shown previously.)

Examples of Cp

-continued
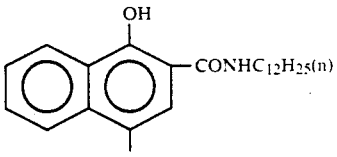
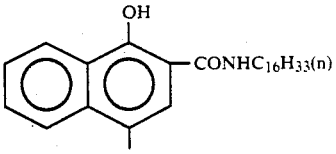
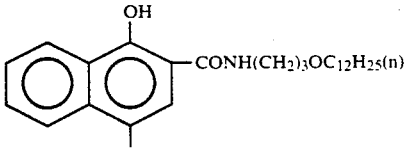
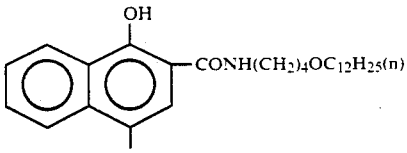
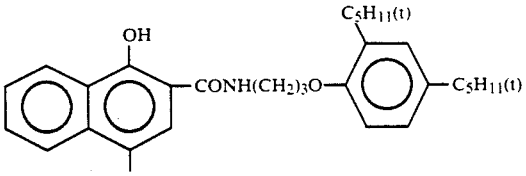
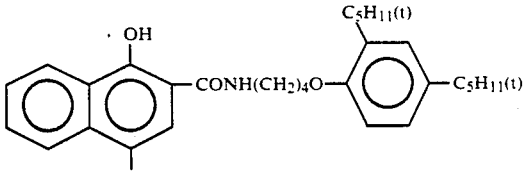
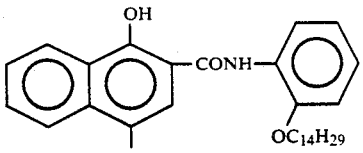
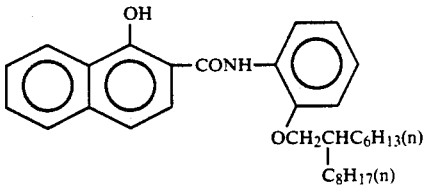
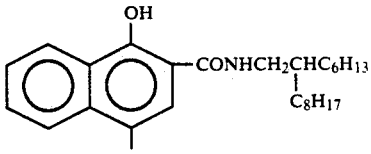

-continued
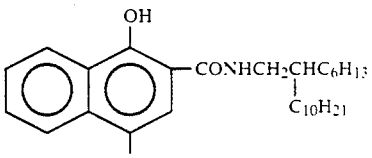
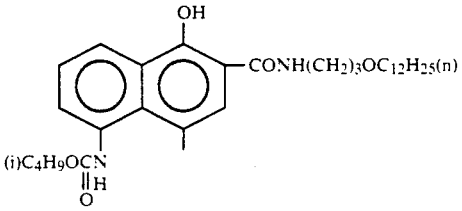
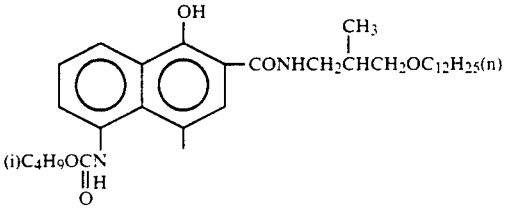
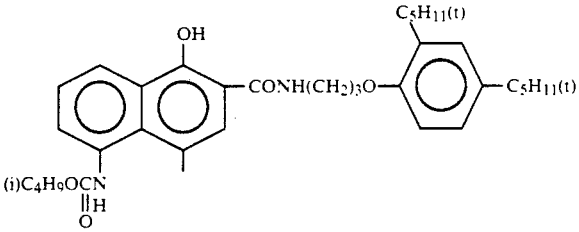
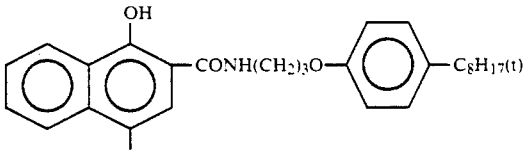
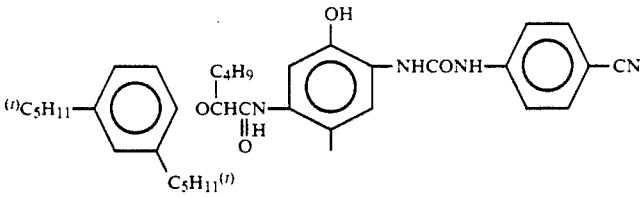
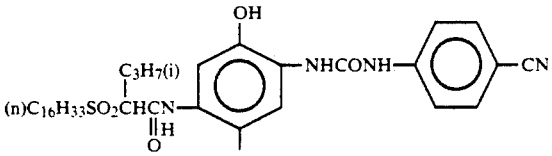
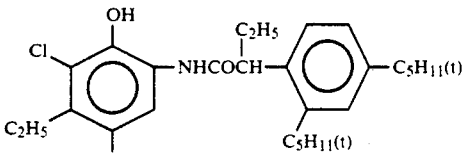

-continued
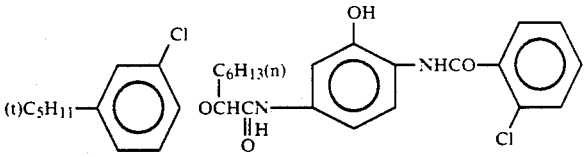
Examples of X
—O—, —S—, —$OCH_2$—, —$OCH_2CH_2$—, —$OCH_2CH_2O$—, —$OCH_2CH_2CH_2O$—,
—$O(CH_2CH_2O)_2$—, —$OCH_2CH_2S$—, —$OCH_2CH_2NHCO$—, —$OCH_2CH_2NHSO_2$—,
—$OCH_2CH_2SO_2$—, —$OCH_2CH_2OCO$—, —$OCH_2CH_2CO$—, —$SCH_2CONH$—,
—$SCH_2COO$—, —$OCH(CH_3)CONH$—, —$OCH_2CH_2OSO_2$—, —OCO—,
—$OCH_2CH(CO_2H)$—, —$OCH_2CH(CO_2H)CH_2$—, —$OCH_2CH(CO_2H)O$—, —$OCH(CO_2H)CH_2O$—,
—$OCH_2CH(CO_2H)S$—, —$OCH_2CH(SO_3Na)O$—,
Examples of O
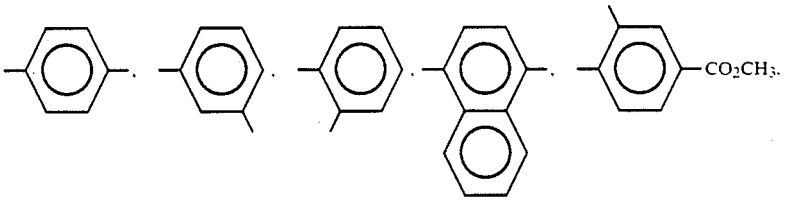
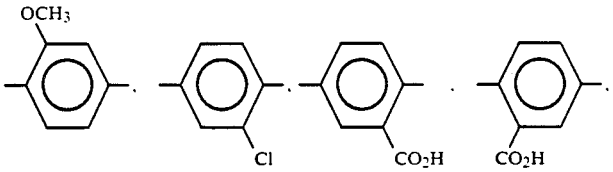
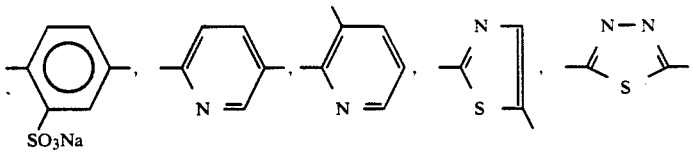
Examples of
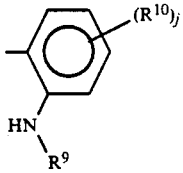
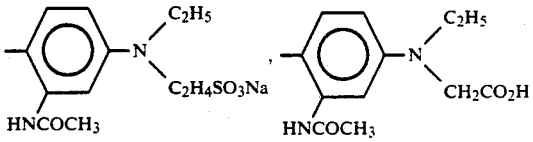

-continued
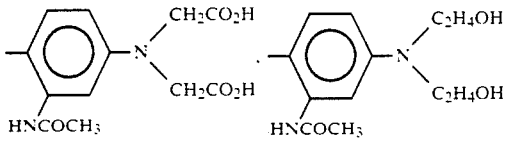
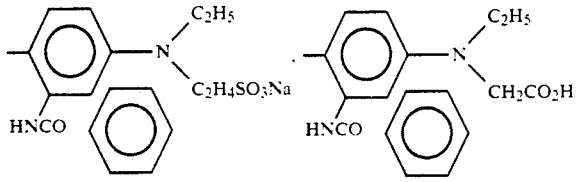
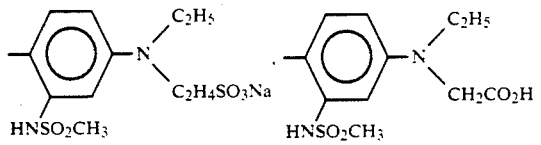
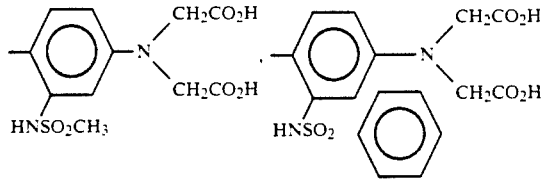
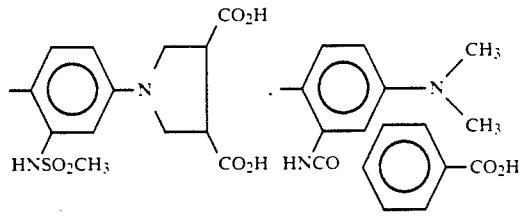
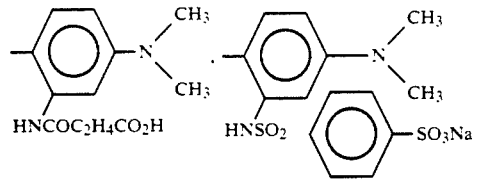
Specific examples of compounds of the present invention represented by general formula (I) are shown below, but the present invention is not limited to these examples.
(I-1)
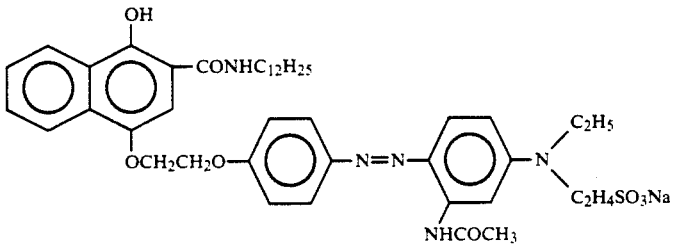

-continued
(I-2)
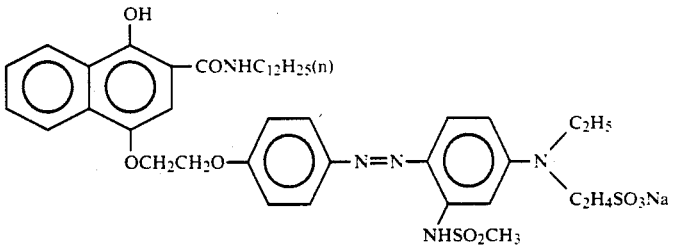
(I-3)
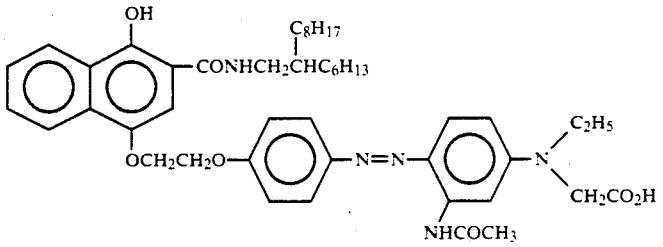
(I-4)
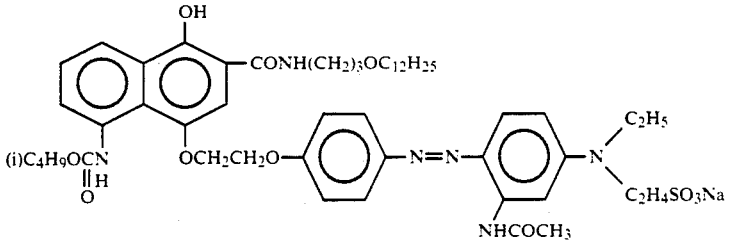
(I-5)
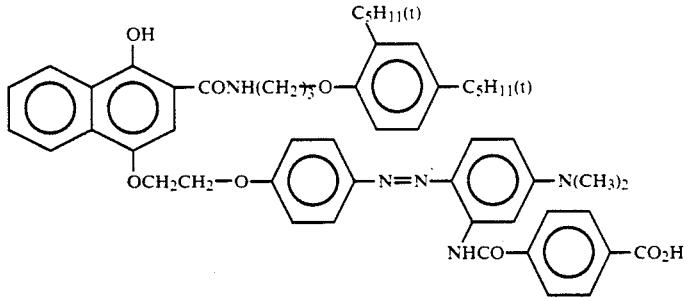
(I-6)
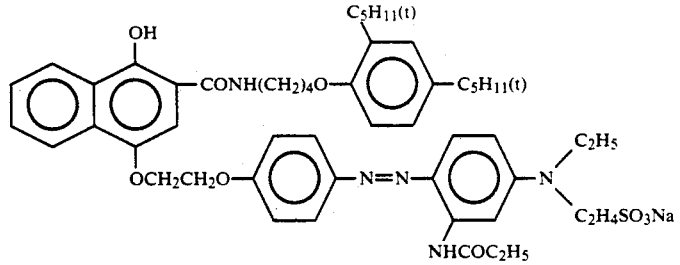
(I- 7)
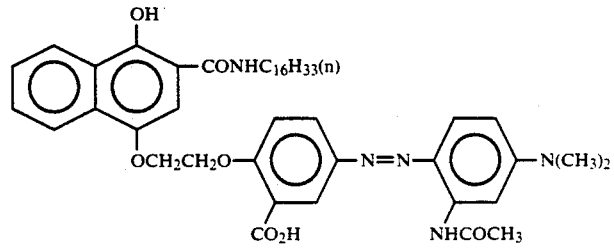

-continued
(I-8)
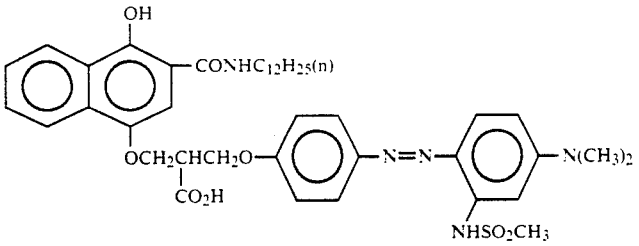
(I-9)
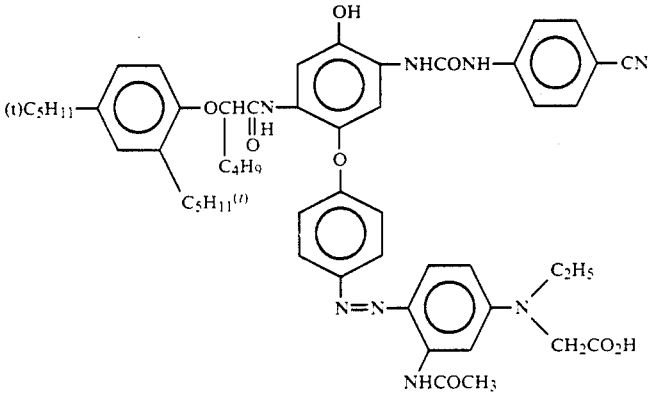
(I-10)
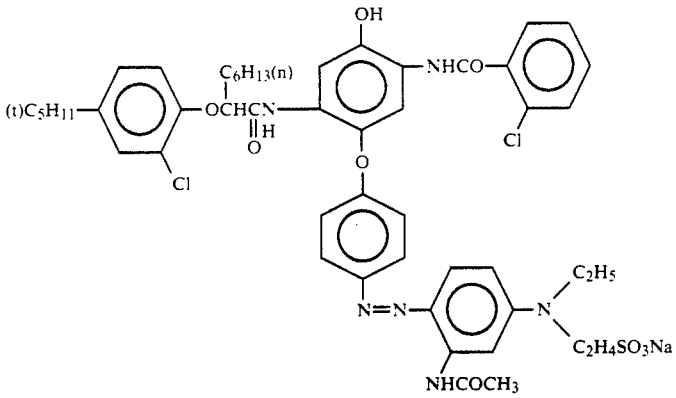
(I-11)
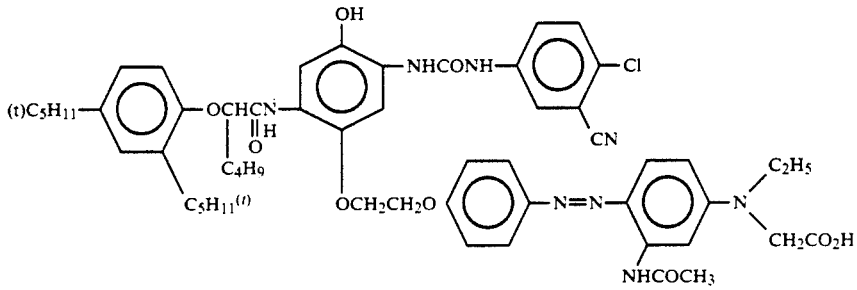

-continued (I-12)

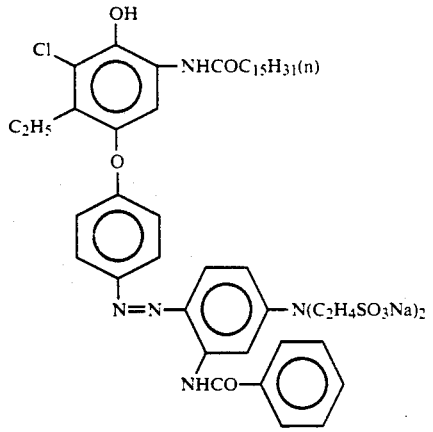

(I-13)

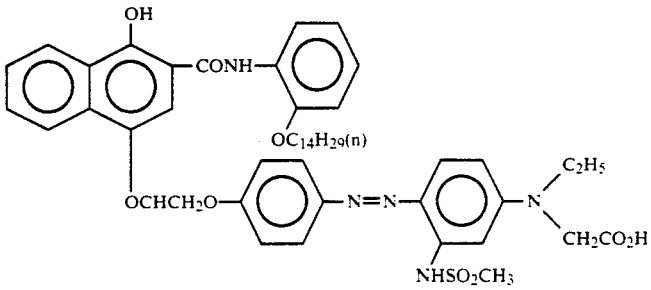

(I-14)

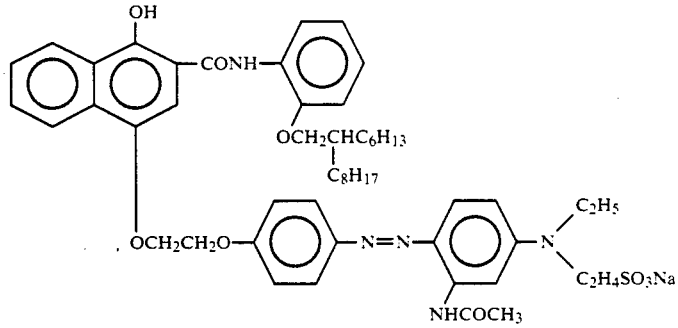

(I-15)

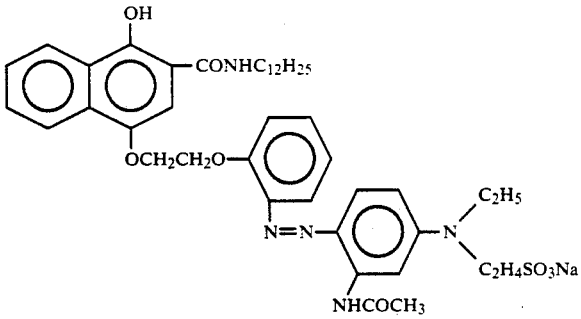

The couplers represented by general formula (I) of the present invention can be prepared using the method disclosed in JP-B-58-6939 or JP-A-1-197563. (The term "JP-B" as used herein means an "examined Japanese patent publication".)

Furthermore, it is possible to obtain silver halide color photographic materials which have both excellent colored image fastness and excellent color reproduction by using yellow colored cyan couplers of the present invention conjointly with cyan color forming couplers represented by general formula (C):

(C)

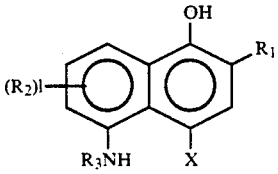

wherein, $R_1$ represents $—CONR_4R_5$, $—SO_2NR_4R_5$, $—NHCOR_4$, $—NHCOOR_6$, $—NHSO_4R_6$, —NH- $CONR_4R_5$ or $—NHSO_2NR_4R_5$; $R_2$ represents a group which can be substituted on a naphthalene ring; represents an integer of from 0 to 3; $R_3$ represents a substituent; and X represents a hydrogen atom or a group which can be eliminated by a coupling reaction with an oxidation product of a primary aromatic amine developing agent. $R_4$ and $R_5$, which may be the same or different, each represents a hydrogen atom, an alkyl group, an aryl group or a heterocyclic group, and $R_6$ represents an alkyl group, an aryl group or a heterocyclic group. When l represents 2 or 3, the $R_2$ groups may be the same or different, or the groups may be joined together to form a ring. $R_2$ and $R_3$, or $R_3$ and X, may be joined together to form a ring. Furthermore, dimers or higher oligomers may be formed by joining together via divalent groups or groups of valency greater than two in $R_1$, $R_2$, $R_3$ or X.

Each of the substituents in formula (C) is described below in detail.

$R_1$ represents $—CONR_4R_5$, $—SO_2NR_4R_5$, $—NHCOR_4$, $—NHCOOR_6$, $—NHSO_2R_6$, $—NHCONR_4R_5$ or $—NHSO_2NR_4R_5$, and $R_4$, $R_5$ and $R_6$ each independently represents an alkyl group which has a total number of carbon atoms (which is sometimes referred to hereinafter as the C number) of from 1 to 30, an aryl group having from 6 to 30 carbon atoms, or a heterocyclic group having from 2 to 30 carbon atoms. $R_4$ and $R_5$ may also be hydrogen atoms.

$R_2$ represents a group (including an atom, hereinafter the same) which can be substituted on a naphthalene ring, and typical examples include a halogen atom (F, Cl, Br, I), hydroxyl group, carboxyl group, amino group, sulfo group, cyano group, alkyl group, aryl group, heterocyclic group, carboxamido group, sulfonamido group, carbamoyl group, sulfamoyl group, ureido group, acyl group, acyloxy group, alkoxy group, aryloxy group, alkylthio group, arylthio group, alkylsulfonyl group, arylsulfonyl group, sulfamoyl group, alkoxycarbonylamino group, nitro group and amido group. Examples when l=2 include the dioxymethylene group and the trimethylene group. The C number of ($R_2$), is from 0 to 30.

$R_3$ represents a substituent, and it is preferably represented by the formula (C-1) indicated below.

$$R_7(Y)_m- \qquad \text{(C-1)}$$

IN formula (C-1), Y represents >NH, >CO or $>SO_2$, m represents an integer of value 0 or 1, and $R_7$ represents a hydrogen atom, an alkyl group having from 1 to 30 carbon atoms, an aryl group having from 6 to 30 carbon atoms, a heterocyclic group having from 2 to 30 carbon atoms,

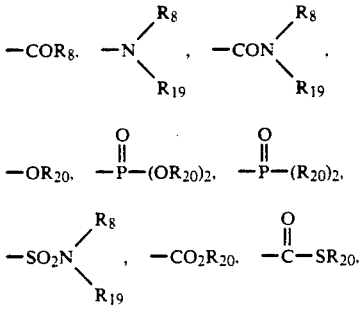

-continued wherein $R_8$, $R_9$ and $R_{20}$ have the same significance as the aforementioned $R_4$, $R_5$ and $R_6$, respectively.

In $R_1$ or $R_7$, $R_4$ and $R_5$ of

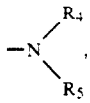

and $R_8$ and $R_{19}$ of

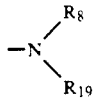

may be joined together to form a nitrogen containing heterocyclic ring (for example, a pyrrolidine, piperidine or morpholine ring).

X represents a hydrogen atom or a group which can be eliminated by a coupling reaction with the oxidation product of a primary aromatic amine developing agent (known as a leaving group, including the atom which is eliminated, hereinafter the same), and typical examples of leaving groups include halogen atoms, $—OR_{11}$, $—SR_{11}$,

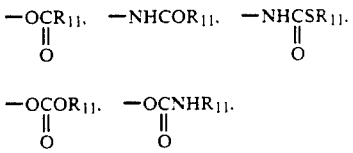

thiocyanato groups, and heterocyclic groups having 1 to 30 carbon atoms which are bonded to the coupling active position by a nitrogen atom (for example, succinimido, phthalimido, pyrazolyl, hydantoinyl, 2-benzotriazolyl), wherein $R_{11}$ has the same significance as the above-described $R_6$.

In the above, the alkyl group may be a straight chain, branched chain or cyclic alkyl group, and may have unsaturated bonds and may have substituents (for example, a halogen atom, a hydroxyl group, an aryl group, a heterocyclic group, an alkoxy group, an aryloxy group, an alkylsulfonyl group, an arylsulfonyl group, an alkoxycarbonyl group, an acyloxy group, an acyl group). Typical examples thereof include methyl, iso-propyl, iso-butyl, tert-butyl, 2-ethylhexyl, cyclohexyl, n-dodecyl, n-hexadecyl, 2-methoxyethyl, benzyl, trifluoromethyl, 3-dodecyloxypropyl and 3-(2,4-di-tert-butylphenoxy)propyl.

Furthermore, the aryl group may be a condensed ring (for example, a naphthyl group) and may have substituents (for example, a halogen atom, an alkyl group, an aryl group, an alkoxy group, an aryloxy group, a cyano group, an acyl group, an alkoxycarbonyl group, a carboxamido group, a sulfonamido group, a carbamoyl group, a sulfamoyl group, an alkylsulfonyl group, an arylsulfonyl group). Typical examples thereof include phenyl, tolyl, pentafluorophenyl, 2-chlorophenyl, 4-hydroxyphenyl hydroxyphenyl, 4-cyanophenyl, 2-tetradecyloxyphenyl, 2-chloro-5-dodecyloxyphenyl and 4-tert-butylphenyl.

Furthermore, the heterocyclic group can be a 3- to 8-membered single or condensed ring heterocyclic group having at least one hetero atom of O, N, S, P, Se or Te in the ring and may have a substituent group (for example, a halogen atom, a carboxyl group, a hydroxyl group, a nitro group, an alkyl group, an aryl group, an alkoxy group, an aryloxy group, an alkoxycarbonyl group, an aryloxycarbonyl group, an amino group, a carbamoyl group, a sulfamoyl group, an alkylsulfonyl group, an arylsulfonyl group). Typical examples thereof include 2-pyridyl, 4-pyridyl, 2-furyl, 4-thienyl, benzotriazol-1-yl, 5-phenyltetrazol-1-yl, 5-methylthio-1,3,4-thiadiazol-2-yl and 5-methyl-1,3,4-oxadiazol-2-yl.

Preferred examples of substituents in the present invention are indicated below.

For $R_1$, $—CONR_4R_5$ or $—SO_2NR_4R_5$ is preferred, and specific examples include carbamoyl, N-n-butylcarbamoyl, N-n-dodecylcarbamoyl, N-(3-n-dodecyloxypropyl)carbamoyl, N-cyclohexylcarbamoyl, N-[3-(2,4-di-tert-pentylphenoxy)-propyl]carbamoyl, N-hexadecylcarbamoyl, N-[4-(2,4-di-tert-pentylphenoxy)-butyl]carbamoyl,N-(3-dodecyloxy-2-methylpropyl, N-(3-dodecyloxy-2-methylpropyl)carbamoyl, N-[3-(4-tert-octylphenoxy)propyl]carbamoyl, N-hexadecyl-N-methylcarbamoyl, N-(3-dodecyloxypropyl)sulfamoyl and N-[N-4-2,4-di-tert-pentylphenoxy)butyl]sulfamoyl. $R_1$ is most preferably $-CONR_4R_5$.

For $R_2$ and l,l is most preferably 0 (i.e., no substituent) and l is preferably 1. $R_2$ is preferably a halogen atom, an alkyl group (for example, methyl, iso-propyl, tert-butyl, cyclopentyl), a carboxamido group (for example, acetamido, pivalamido, trifluoroacetamido, benzamido), a sulfonamido group (for example, methanesulfonamido, toluenesulfonamido) or a cyano group.

In the substituent $R_3$ represented by the formula (C-1), m is preferably 0 and more preferably $R_7$ is $—COR_8$ (for example, formyl, acetyl, trifluoroacetyl, 2-ethylhexanoyl), pivaloyl, benzoyl, pentafluorobenzoyl, 4-(2,4-di-tert-pentylphenoxy)butanoyl), $—COOR_{20}$ (for example, methoxycarbonyl, ethoxycarbonyl, isobutoxycarbonyl, 2-ethylhexyloxycarbonyl, n-dodecyloxycarbonyl, 2-methoxyethoxycarbonyl) or $SO_2R_{20}$ (for example, methanesulfonyl, n-butylsulfonyl, n-hexylsulfonyl, phenylsulfonyl, p-tolylsulfonyl, p-chlorophenylsulfonyl, trifluoromethylsulfonyl), and $R_7$ is most preferably $—COOR_{20}$.

X is preferably a hydrogen atom, a halogen atom, $—OR_{11}$ (for example, alkoxy groups such as ethoxy, 2-hydroxyethoxy, 2-methoxyethoxy, 2-(2-hydroxyethoxy)ethoxy, 2-methylsulfonylethoxy, ethoxycarbonylmethoxy, carboxymethoxy, 3-carboxypropoxy, N-(2-methoxyethyl)carbamoylmethoxy, 1-carboxytridecyloxy, 2-methanesulfonamidoethoxy, 2-(carboxymethylthio)ethoxy, 2-(1-carboxytridecyloxy)ethoxy and aryloxy groups such as 4-cyanophenoxy, 4-carboxyphenoxy, 4-methoxyphenoxy, 4-tert-octylphenoxy, 4-nitrophenoxy, 4-(3-carboxypropanamido)phenoxy, 4-acetamidophenoxy), or $-SR_{11}$ (for example, alkylthio groups such as carboxymethylthio, 2-carboxymethylthio, 2-ethoxyethylthio, ethoxycarbonylmethylthio, 2,3-dihydroxypropylthio, 2-(N,N-dimethylamino)ethylthio and arylthio groups such as 4-carboxyphenylthio, 4-methoxyphenylthio, 4-(3-carboxypropanamido)phenylthio. X is most preferably a hydrogen atom, a chlorine atom, an alkoxy group or an alkylthio group.

The couplers represented by general formula (C) may form dimers or higher oligomers by bonding together via groups of valency two or more in the substituents $R_1$, $R_2$, $R_3$ or X. In this case, the above-described substituents may have a number of carbon atoms outside the indicated carbon number range.

In those cases where a coupler represented by the general formula (C) forms an oligomer, it is typically a homopolymer or copolymer of an addition polymerizable ethylenically unsaturated compound which has a cyan dye forming coupler residual group (cyan color forming monomer), and it is preferably represented by formula (C-2):

$$-(G_i)_{gi}-(H_j)_{hj}- \qquad \text{(C-2)}$$

In formula (C-2), $G_i$ is a repeating unit derived from a color forming monomer and is a group represented by formula (C-3), and $H_j$ is a group which forms a repeating unit derived from a non-color forming monomer, gi is a positive integer and hj is 0 or a positive integer, and gi and hi indicate the proportions by weight of $G_i$ and $H_j$ respectively. Here, when gi or hj is two or more, $G_i$ or $H_i$ include a number of types of repeating unit.

Formula (C-3) is shown below:

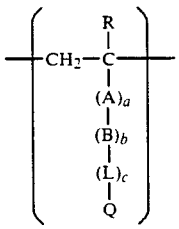

(C-3)

In formula (C-3), R represents a hydrogen atom, an alkyl group having from 1 to 4 carbon atoms or a chlorine atom, A represents —CONH—, —COO— or a substituted or unsubstituted phenylene group, B represents a divalent group which has a carbon atom at both ends, such as an unsubstituted alkylene group, a phenylene group, an oxydialkylene group, and L represents —CONH—, —NHCONH—, —NHCOO—, —NHCO—, —OCONH—, —NH—, —COO—, —OCO—, —CO—, —O—, $—SO_2—$, $—NHSO_2—$ or $—SO_2NH—$. a, b and c each represents an integer of 0 or 1. Q represents a cyan coupler residual group in which one hydrogen atom has been removed from $R_1$, $R_2$, $R_3$ or X of a compound represented by the general formula (C).

The non-color forming ethylenic type monomer which provides Hj and which does not couple with the oxidation product of a primary aromatic amine, may be, for example, acrylic acid, α-acryloacrylic acid, α-alkylacrylic acid (for example, methacrylic acid), amides and esters derived from these acrylic acids (for example, acrylamide, methacrylamide, n-butylacrylamide, tert-butylacrylamide, diacetoneacrylamide, methyl acrylate, ethyl acrylate, n-propyl acrylate, n-butyl acrylate, tert-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxyethyl methacrylate), vinyl esters (for example, vinyl acetate, vinyl propionate and vinyl laurate), acrylonitrile, methacrylonitrile, aromatic vinyl compounds (for example, styrene and derivatives thereof, such as vinyl toluene, divinyl benzene, vinyl acetophenone and sulfostyrene), itaconic acid, citraconic acid, crotonic acid, vinylidene chloride, vinyl alkyl ether (for example, vinyl ethyl ether), maleic acid esters, N-vinyl-2-pyrrolidone, N-vinylpyridine and 2- and 4-pyrrolidone.

The acrylic acid esters, methacrylic acid esters and maleic acid esters are especially preferred. Two or more types of non-color forming ethylenic monomer can be used conjointly. For example, use can be made of methyl acrylate and butyl acrylate, butyl acrylate and styrene, butyl methacrylate and methacrylic acid o methyl acrylate and diacetoneacrylamide.

The ethylenically unsaturated monomer for copolymerization with the vinyl type monomer corresponding to the aforementioned formula (C) can be selected in such a way that the form of the copolymer which is obtained, for example, whether it has a solid, liquid or micelle form, and the physical and/or chemical properties, for example, solubility (solubility in water or organic solvents), compatibility with binding agents such as gelatin, for example, which are used in photographic colloid compositions, flexibility, heat stability, coupling activity with the oxidation product of developing agents and fastness to diffusion in photographic colloids, are all favorably affected as is well known in the polymer coupler field. These copolymers may be random copolymers or copolymers which have a specified sequence (for example, block copolymers, alternate copolymers).

The number average molecular weight of the cyan polymer couplers used in the present invention is generally from a several thousand to a several million, and oligomeric polymer couplers of number average molecular weight less than 5000 can also be used.

The cyan polymer couplers used in the present invention may be lipophilic polymers which are soluble in organic solvents (for example, ethyl acetate, butyl acetate, ethanol, methylene chloride, cyclohexanone, dibutyl phthalate, tricresyl phosphate) or hydrophilic polymers which can be mixed with hydrophilic colloids such as aqueous gelatin solutions, or they may be polymers which have a structure and nature which can form micelles in hydrophilic colloids.

The selection of lipophilic non-color forming ethylenic monomers (for example, acrylic acid esters, methacrylic acid esters, maleic acid esters, vinylbenzenes) for the main copolymer component is preferably for obtaining lipophilic polymer couplers which are soluble in organic solvents.

A lipophilic polymer coupler obtained by polymerizing a vinyl monomer which provides coupler units represented by the above-described general formula (C-3) can be dissolved in an organic solvent and emulsified and dispersed in the form of a latex in an aqueous gelatin solution, or it can be prepared using a direct emulsion polymerization method.

The method for the emulsification and dispersion of lipophilic polymer couplers in aqueous gelatin solutions disclosed in U.S. Pat. No. 3,451,820 can be used, and the methods disclosed in U.S. Pat. Nos. 4,080,211 and 3,370,952 can be used for emulsion polymerization.

Furthermore, the use of hydrophilic non-color forming ethylenic monomers such as N-(1,1-dimethyl-2-sulfonatoethyl)acrylamide, 3-sulfonatopropyl acrylate, sodium styrene-sulfonate, potassium styrenesulfonate, acrylamide, methacrylamide, acrylic acid, methacrylic acid, N-vinylpyrrolidone, and N-vinylpyridine, for example, as copolymer components is preferred for obtaining hydrophilic polymer couplers which are soluble in neutral or alkaline water.

Hydrophilic polymer couplers can be added as aqueous solutions to a coating liquid, and they can also be dissolved in mixed solvents consisting of water and an organic solvent which is miscible with water such as a lower alcohol, tetrahydrofuran, acetone, ethyl acetate, cyclohexanone, ethyl lactate, dimethylformamide or dimethylacetamide for addition. Furthermore, a small amount of surfactant can be added.

Specific examples of the substituents in formula (C) and of cyan couplers represented by formula (C) are shown below.

Examples of $R_1$ $-CONH(CH_2)_3O-A$ $-CONH(CH_2)_4O-A$ $-CONH(CH_2)_3OC_{12}H_{25}\text{-}n$ $-CONH(CH_2)_3OC_{10}H_{21}\text{-}n$ $-CONH(CH_2)_3OCH_2\overset{C_2H_5}{\overset{|}{C}}HC_4H_9\text{-}n$ $-CONHC_{16}H_{33}\text{-}n$ $-CONHCH_2\overset{CH_3}{\overset{|}{C}}HCH_2C_{12}H_{25}\text{-}n$ $-CONH(CH_2CH_2O)_2C_{12}H_{25}\text{-}n$ $-CONHCH_2CH_2OC_{12}H_{25}\text{-}n$

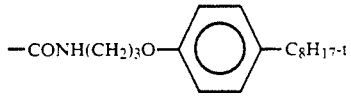

$-CONHCH_2\overset{C_6H_{13}}{\overset{|}{C}}HC_8H_{17}\text{-}n$

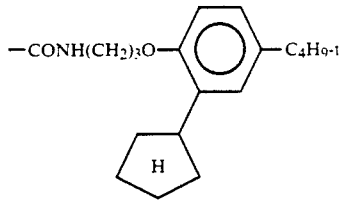

$-CONHC_4H_9\text{-}n$

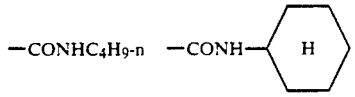

$-CON(CH_3)(C_{16}H_{33}\text{-}n)$ $-CONH(CH_2)_3OC_{14}H_{29}\text{-}n$ $-CONH(CH_2)_3OC_{11}H_{23}\text{-}n$ $-SO_2NH(CH_2)_3OC_{12}H_{25}\text{-}n$

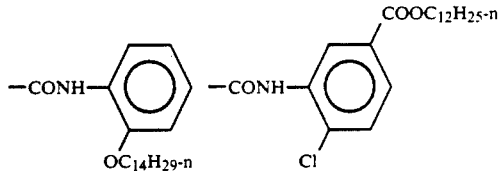

$-SO_2N(C_8H_{17}\text{-}n)(C_8H_{17}\text{-}n)$ $-NHCO(CH_2)_3O-A$

-continued

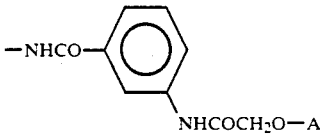

$-NHSO_2C_{16}H_{33}$-n

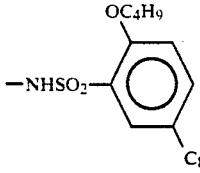

$-NHCOOC_{12}H_{25}$-n

Examples of $R_2$ $-F$ $-Cl$ $-CN$ $-CH_3$ $-CF_3$ $-C_4H_9$-t $-C_8H_{17}$-t $-NHCOCH_3$ $-NHSO_2CH_3$ $-NHCOOC_2H_5$ $-O-$

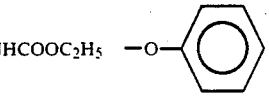

$-S-$

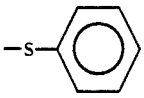

$-OC_8H_{17}$-n

Examples of $R_3NH-$ $-NHCOCH_3$ $-NHCOCF_3$ $-NHCO-$

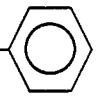

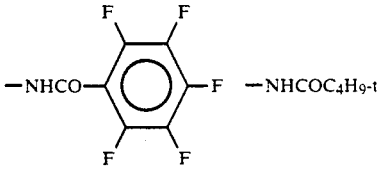

$-NHCOC_4H_9$-t $-NHCO(CH_2)_3O-A$ $-NHCO-$

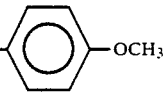

$-OCH_3$ $-NHCO-$

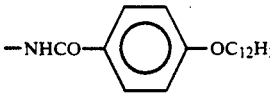

$-OC_{12}H_{25}$-n $-NHSO_2CH_3$ $-NHSO_2CF_3$ $-NHSO_2C_4H_9$-n $-NHSO_2-$

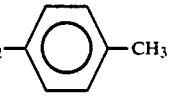

$-CH_3$ $-NHSO_2-$

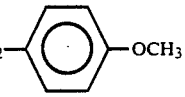

$-OCH_3$ $-NHCON(CH_3)_2$ $-NHSO_2N(CH_3)_2$

-continued

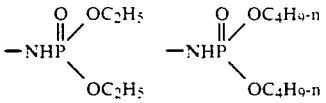

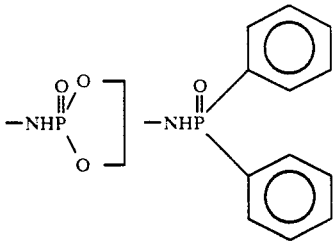

$-NHCOOCH_3$ $-NHCOOCH_2CH(CH_3)_2$ $-NHCOOC_4H_9$-n $-NHCOOCH_2CH_2OCH_3$ $-NHCOOCH_2CH(C_2H_5)C_4H_9$ $-NHCOOC_{12}H_{25}$-n $-NHCOOCH_2CH_2O-A$ $-NHCOCOCH_3$

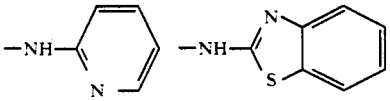

Examples of X $-OC_2H_5$ $-OCH_2CH_2OH$ $-OCH_2CH_2SO_2CH_3$ $-O(CH_2CH_2O)_2H$ $-OCH_2COOH$ $-O(CH_2)_3COOH$ $-OCH_2COOC_2H_5$ $-OCH_2CONHCH_2CH_2OCH_3$ $-OCH_2CH_2SCH_2COOH$ $-OCH_2CH_2S(C_{12}H_{25}\text{-}n)CHCOOH$ $-OCH_2CH_2OCH_3$ $-OCH_2CH_2NHSO_2CH_3$

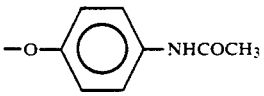

$-NHCOCH_3$

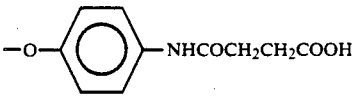

$-NHCOCH_2CH_2COOH$

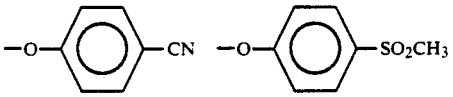

$-CN$ $-SO_2CH_3$

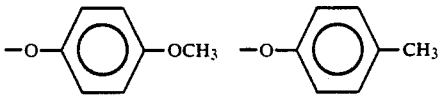

$-OCH_3$ $-CH_3$ $-SCH_2COOH$ $-SCH_2CH_2COOH$ $-SCH(CH_3)COOH$ $-SCH_2COOC_2H_5$ $-SCH_2CH_2OH$ $-SCH_2CH(OH)CH_2OH$

-continued

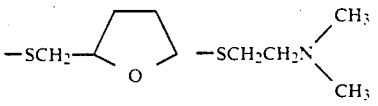

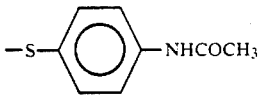

-continued

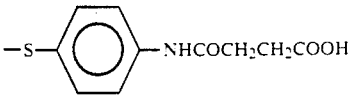

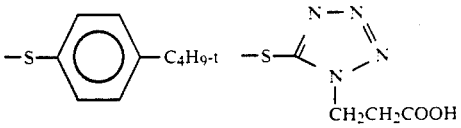

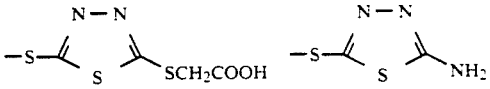

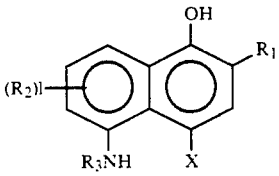

Coupler with l = O

| No. | $R_1$ | $R_3$ | X |
|---|---|---|---|
| C-1 | $-CONH(CH_2)_3O-A$ | $CH_3CO-$ | H |
| C-2 | $-CONH(CH_2)_3O-A$ | $CF_3CO-$ | H |
| C-3 | $-CONH(CH_2)_3O-A$ | $CH_3SO_2-$ | H |
| C-4 | $-CONH(CH_2)_3O-A$ | $C_2H_5OCO-$ | H |
| C-5 | $-CONH(CH_2)_4O-A$ | $t\text{-}C_4H_9CO-$ | H |
| C-6 | $-CONH(CH_2)_3O-C_{12}H_{25}\text{-}n$ | $C_2H_5OCO-$ | H |
| C-7 | $-CONH(CH_2)_3O-C_{12}H_{25}\text{-}n$ | $i\text{-}C_4H_9OCO-$ | H |
| C-8 | $-CONH(CH_2)_3OC_{10}H_{21}\text{-}n$ | $i\text{-}C_4H_9OCO-$ | H |
| C-9 | $-CONH(CH_2)_3OC_{10}H_{21}\text{-}n$ | $n\text{-}C_4H_9CH(C_2H_5)CH_2OCO-$ | H |
| C-10 | $-CONH(CH_2)_3O-A$ | $i\text{-}C_4H_9OCO-$ | H |
| C-11 | 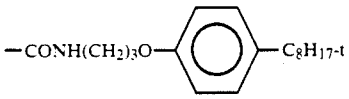 | $i\text{-}C_4H_9OCO-$ | H |
| C-12 | $-CONHCH_2CH(CH_3)CH_2OC_{12}H_{25}\text{-}n$ | $i\text{-}C_4H_9OCO-$ | H |
| C-13 | $-CONH(CH_2)_3OCH_2CH(C_2H_5)C_4H_9$ | $n\text{-}C_8H_{17}OCO-$ | H |
| C-14 | 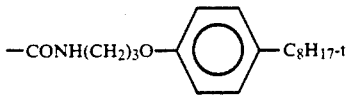 | $n\text{-}C_4H_9SO_2-$ | H |
| C-15 | $-CONH(CH_2)_3OC_{12}H_{25}\text{-}n$ | $(C_2H_5O)_2P(=O)-$ | H |
| C-16 | $-CONH(CH_2)_3O-A$ | 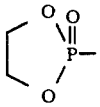 | H |
| C-17 | $-CONHCH_2CH_2OC_{12}H_{25}\text{-}n$ | $i\text{-}C_4H_9OCO-$ | H |

-continued

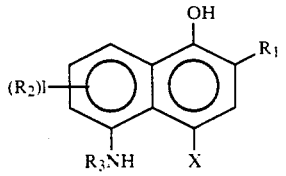

Coupler with l = O

| No. | $R_1$ | $R_3$ | X |
|---|---|---|---|
| C-18 | $-CON(CH_3)(C_{16}H_{33}\text{-n})$ | $C_2H_5OCO-$ | H |
| C-19 | $-CONHCH_2CH_2OCOC_{11}H_{23}\text{-n}$ | $i\text{-}C_4H_9OCO-$ | H |
| C-20 | $-CONHC_{12}H_{25}\text{-n}$ | $n\text{-}C_4H_9CH(CH_3)CH_2OCO-$ | H |
| C-21 | $-SO_2NH(CH_2)_3OC_{12}H_{25}\text{-n}$ | $i\text{-}C_4H_9OCO-$ | H |
| C-22 | $-SO_2N(CH_3)(C_{18}H_{37}\text{-n})$ | $C_2H_5OCO-$ | H |
| C-23 | $-CONHCH_2CH(C_6H_{13}\text{-n})C_8H_{17}\text{-n}$ | $i\text{-}C_4H_9OCO-$ | H |
| C-24 | $-CONH(CH_3)_3OC_{12}H_{25}\text{-n}$ | 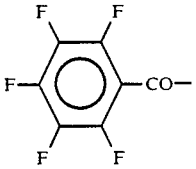 | H |
| C-25 | 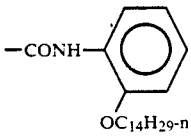 | $CH_3SO_2-$ | H |
| C-26 | 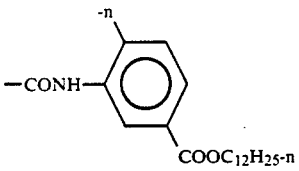 | 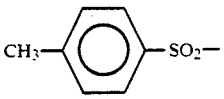 | H |
| C-27 | $-CONH(CH_2)_3OC_{12}H_{25}\text{-n}$ | $i\text{-}C_4H_9OCO-$ | Cl |
| C-28 | $-CONH(CH_2)_3OC_{12}H_{25}\text{-n}$ | $n\text{-}C_4H_9OCO-$ | Cl |
| C-29 | $-CONH(CH_2)_3OC_{14}H_{29}\text{-n}$ | $t\text{-}C_4H_9CO-$ | Cl |
| C-30 | $-CONH(CH_2)_3OC_{12}H_{25}\text{-n}$ | $i\text{-}C_4H_9OCO-$ | $-OCH_2CH_2OH$ |
| C-32 | $-CONH(CH_2)_3OC_{12}H_{25}\text{-n}$ | $i\text{-}C_4H_9OCO-$ | $-O(CH_2CH_2O)_2H$ |
| C-33 | $-CONH(CH_2)_3OC_{12}H_{25}\text{-n}$ | $i\text{-}C_4H_9OCO-$ | $-OCH_2CH_2OCH_3$ |
| C-34 | $-CONH(CH_2)_3OC_{12}H_{25}\text{-n}$ | $i\text{-}C_4H_9OCO-$ | $-OCH_2CH_2SCH_2COOH$ |
| C-35 | $-CONHC_4H_9\text{-n}$ | $i\text{-}C_4H_9OCO-$ | $-OCH_2CH_2SCH(COOH)C_{12}H_{25}\text{-n}$ |
| C-36 | $-CONHCH_2CH(CH_3)CH_2OC_{12}H_{25}\text{-n}$ | $i\text{-}C_4H_9OCO-$ | $-O(CH_2)_3COOH$ |
| C-37 | $-CONH(CH_2)_4O-A$ | $i\text{-}C_4H_9OCO-$ | 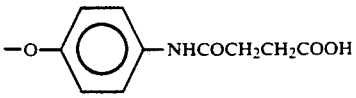 |

-continued

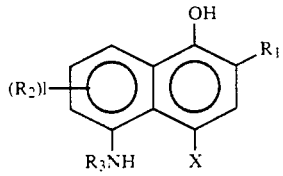

Coupler with l = O

| No. | $R_1$ | $R_3$ | X |
|---|---|---|---|
| C-38 | $-CONH(CH_2)_3O-A$ | $i\text{-}C_4H_9OCO-$ | 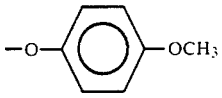 |
| C-39 | 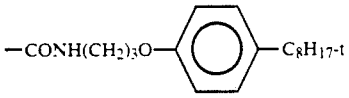 | $i\text{-}C_4H_9OCO-$ | $-SCH_2COOH$ |
| C-40 | $-CONH(CH_2)_3OC_{12}H_{25}\text{-}n$ | $i\text{-}C_4H_9OCO-$ | $-SCH_2CH_2COOH$ |
| C-41 | $-CONH(CH_2)_3OC_{12}H_{25}\text{-}n$ | $i\text{-}C_4H_9OCO-$ | $-SCH_2CH_2OH$ |
| C-42 | $-CONH(CH_2)_4O-A$ | $CH_3SO_2-$ | 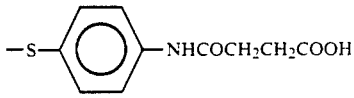 |
| C-43 | $-SO_2NH(CH_2)_3O-A$ | $n\text{-}C_4H_9SO_2-$ | $-OCH_2CH_2OH$ |
| C-44 | $-CONHCH_2\overset{CH_3}{\overset{\vert}{C}}HCH_2OC_{12}H_{25}\text{-}n$ | $i\text{-}C_4H_9OCO-$ | $-OCH_2CH_2OH$ |
| C-45 | $-CONH(CH_2CH_2O)C_{12}H_{25}\text{-}n$ | $(C_2H_5O)_2\overset{O}{\overset{\Vert}{P}}-$ | $-OCH_2CH_2OCH_3$ |
| C-46 | $-CONH(CH_2)_4O-A$ | $t\text{-}C_4H_9CO-$ | $-OCH_2COOC_2H_5$ |

Other Couplers

C-47

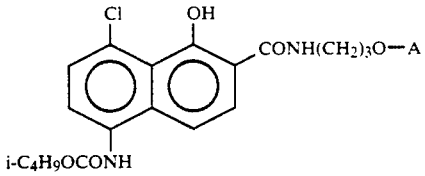

C-48

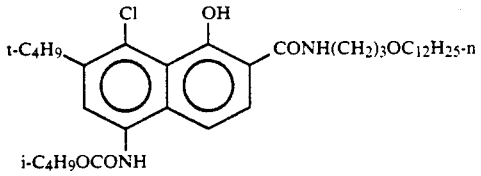

C-49

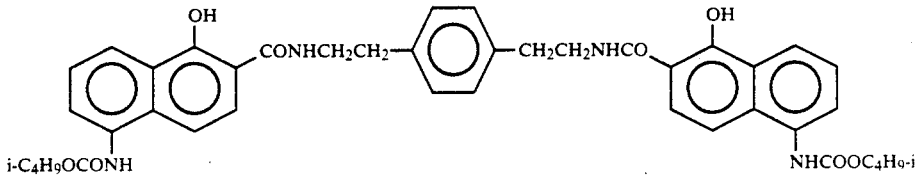

-continued

Other Couplers

C-50

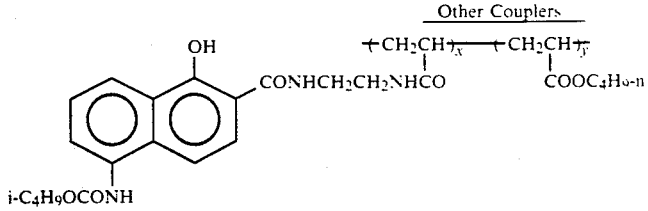

x:y = 60:40 (by weight)
Number Average Molecular Weight = about 60,000

C-51

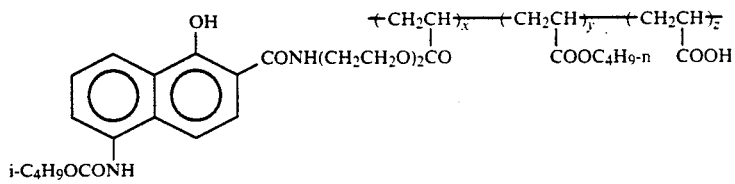

x:y:z = 50:40:10
Number Average Molecular Weight = about 50,000

C-52

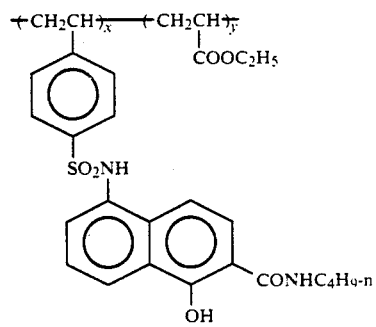

x:y = 70:30
Number Average Molecular Weight = about 55,000.

In the preceding examples of substituents in formula (C) and of cyan couplers C-1 to C-52 represented by formula (C), A represents

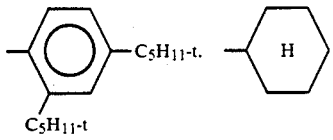

represents a cyclohexyl group,

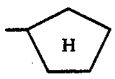

represents a cyclopentyl group and —$C_8H_{17}$-t represents

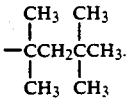

Specific examples of cyan couplers represented by formula (C) other than those aforementioned and/or methods for the synthesis of these compounds have been disclosed, for example, in U.S. Pat. No. 4,690,889, JP-A-60-237448, JP-A-61-153640, JP-A-61-145557, JP-A-63-20842, JP-A-64-31159 and West German Patent 3,823,049A.

The photographic materials of the present invention should have, on a support, at least one blue sensitive layer, at least one green sensitive layer and at least one red sensitive layer, but no particular limitation is imposed upon the number or order of the silver halide emulsion layers and non-photosensitive layers. Typically, silver halide photographic materials have, on a support, at least one photosensitive layer comprised of a plurality of silver halide layers which have essentially the same color sensitivity but different photosensitivities, the photosensitive layer being a unit photosensitive layer which is color sensitive to blue light, green light or red light, and in multi-layer silver halide color photographic materials the arrangement of the unit photosensitive layers generally involves the establishment of the layers in the order, from the support side, of red sensitive layer, green sensitive layer, blue sensitive layer. However, this order may be reversed, as required, and the layers may be arranged in such a way that a layer which has a different color sensitivity is sandwiched between layers which have the same color sensitivity.

Various non-photosensitive layers, such as intermediate layers, may be established between the silver halide photosensitive layers, and as uppermost and lowermost layers.

The intermediate layers may contain couplers and DIR compounds such as those disclosed in JP-A-61-43748, JP-A-59-113438, JP-A-59-113440, JP-A-61-20037 and JP-A-61-20038, and they may also contain the generally used anti-color mixing compounds.

The plurality of silver halide emulsion layers constituting each unit photosensitive layer is preferably a double layer structure comprised of a high sensitive emulsion layer and a low sensitive emulsion layer as disclosed in West German Patent 1,121,470 or British Patent 923,045. Generally, arrangements in which the photosensitivity is lower in the layer closer to the support are preferred, and non-photosensitive layers may be established between each of the silver halide emulsion layers. Furthermore, the low sensitive layers may be arranged on the side furthest away from the support and the high sensitive layers may be arranged on the side closest to the support as disclosed, for example, in JP-A-57-112751, JP-A-62-200350, JP-A-62-206541 and JP-A-62-206543.

In practical embodiments, the arrangement may be, from the side furthest from the support, low sensitive blue sensitive layer (BL)/high sensitive blue sensitive layer (BH)/high sensitive green sensitive layer (GH)/low sensitive green sensitive layer (GL)/high sensitive red sensitive layer (RH)/low sensitive red sensitive layer (RL), or BH/BL/GL/GH/RH/RL, or BH/BL/GH/GL/RL/RH.

Furthermore, the layers can be arranged in the order, from the side furthest from the support, of blue sensitive layer/GH/RH/GL/RL as disclosed in JP-B-55-34932. Furthermore, the layers can also be arranged in the order, from the side furthest away from the support, of blue sensitive layer/GL/RL/GH/RH, as disclosed in JP-A-56-25738 and JP-A-62-63936.

Furthermore, arrangements in which there are three layers which have different photosensitivities with the sensitivity falling towards the support with a high sensitive silver halide emulsion layer at the top, a silver halide emulsion layer which has a lower sensitivity than the aforementioned layer as an intermediate layer and a silver halide emulsion layer which has a lower sensitivity than the intermediate layer as a bottom layer, as disclosed in JP-B-49-15495, can also be used. In the case of structures of this type which have three layers with different speeds, the layers in a layer of the same color sensitivity may be arranged in the order, from the side furthest from the support, of intermediate sensitive emulsion layer/high sensitive emulsion layer/low sensitive emulsion layer, as disclosed in JP-A-59-202464.

Furthermore, the layers can be arranged in the order high sensitive emulsion layer/low sensitive emulsion layer/intermediate sensitive emulsion layer, or low sensitive emulsion layer/intermediate sensitive emulsion layer/high sensitive emulsion layer for example.

Furthermore, the arrangement may be varied in the ways indicated above in cases where there are four or more layers.

Arrangements in which donor layers (CL) which have a laminating effect and of which the spectral sensitivity distribution differs from that of the principal photosensitive layer such as the BL, GL, RL etc. are adjacent to, or in the proximity of, the principal photosensitive layers, as disclosed in U.S. Pat. Nos. 4,663,271, 4,705,744 and 4,707,436, JP-A-62-106448 and JP-A-63-89850, are preferred for improving color reproduction.

As described above, various layer structures and arrangements can be selected respectively according to the purpose of the photosensitive material.

The preferred silver halides for inclusion in the photographic emulsion layers of the photographic material used in the present invention are silver iodobromides, silver iodochlorides or silver iodochlorobromides which contain not more than about 30 mol. % of silver iodide. Most preferably, the silver halide is a silver iodobromide or silver iodochlorobromide which contains from about 2 mol. % to about 25 mol. % of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain size of the silver halide may be very fine, at less that about 0.2 microns, or large with a projected area diameter of up to about 10 microns, and the emulsions may be poly-disperse emulsions or mono-disperse emulsions.

Photographic emulsions which can be used in the present invention can be prepared, for example, using the methods disclosed in *Research Disclosure* (RD) No. 17643 (Dec., 1978), pages 22–23, "I. Emulsion Preparation and Types", and *Research Disclosure* No. 18716 (Nov. 1979), page 648, by P. Glafkides in *Chimie et Physique Photographique*, published by Paul Montel, 1967, by G. F. Duffin in *Photographic Emulsion Chemistry*, published by Focal Press, 1966, and by V. L. Zelikmann et al. in *Making and Coating Photographic Emulsions*, published by Focal Press, 1964.

The mono-disperse emulsions disclosed, for example, in U.S. Pat. Nos. 3,574,628 and 3,655,394, and British Patent 1,413,748 are also desirable.

Furthermore, tabular grains which have an aspect ratio of at least about 5 can be used in the invention. Tabular grains can be prepared easily using the methods described, for example, by Gutoff in *Photographic Science and Engineering*, Volume 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure and, moreover, silver halides which have different compositions may be joined with an epitaxial junction or they may be joined with compounds other than silver halides, such as silver thiocyanate or lead oxide, for example. Furthermore, mixtures of grains which have various crystalline forms can be used.

The silver halide emulsions used have generally been subjected to physical ripening, chemical ripening and spectral sensitization. Additives which are used in such processes have been disclosed in *Research Disclosure* Nos. 17643 and 18716, and the locations of these disclosures are summarized in the table below.

The use of non-photosensitive fine grained silver halides is desirable in the present invention. Non-photosensitive fine grained silver halides are fine grained silver halides which are not photosensitive at the time of the imagewise exposure for obtaining the dye image and which undergo essentially no development during development processing, and those which have not been pre-fogged are preferred.

The fine grained silver halide has a silver bromide content from 0 to 100 mol. %, containing silver chloride and/or silver iodide as required. Those which have a silver iodide content of from 0.5 to 10 mol. % are preferred.

The fine grained silver halide preferably has an average grain size (the average value of the diameters of the circles corresponding to the projected areas) of from 0.01 to 0.5 μm, and most desirably the average grain size is from 0.02 to 0.2 μm.

The fine grained silver halide can be prepared using the same methods as used in general for the preparation of photosensitive silver halides. In this case, the surface of the silver halide grains does not need to be optically sensitized and neither is there any need for spectral sensitization. However, the pre-addition of known stabilizers such as triazole, azaindene, benzothiazolium or mercapto based compounds or zinc compounds before addition to the coating liquid is desirable.

Known photographically useful additives which can be used in this present invention are also disclosed in the two *Research Disclosures* referred to above, and the locations of these disclosures are also indicated in the table below.

| Type of Additive | RD 17643 | RD 18716 |
|---|---|---|
| 1. Chemical sensitizers | Page 23 | Page 648, right col. |
| 2. Speed increasing agents | | As above |
| 3. Spectral sensitizers and Super-sensitizers | Pages 23–24 | Pages 648 right col. to 649 right col. |
| 4. Whitening Agents | Page 24 | |
| 5. Anti-foggants & Stabilizers | Pages 25–25 | Page 649, right col. |
| 6. Light absorbers, filter dyes and UV absorbers | Pages 25–26 | Pages 649, right col. to 650, left col. |
| 7. Anti-staining agents | Page 25, right col. | Page 650, left–right cols. |
| 8. Dye image stabilizers | Page 25 | |
| 9. Film hardening agents | Page 26 | Page 651, left col. |
| 10. Binders | Page 26 | As above |
| 11. Plasticizers, lubricants | Page 27 | page 650, right col. |
| 12. Coating promotors, Surfactants | Pages 26–27 | Page 650, right col. |
| 13. Anti-static agents | Page 27 | As above |

Furthermore, the addition of the compounds disclosed in U.S. Pat. Nos. 4,411,987 and 4,435,503 which can react with and fix formaldehyde to the photosensitive material is desirable for preventing the deterioration of photographic performance due to formaldehyde gas.

Various color couplers can be used in the present invention, and specific examples have been disclosed in the patents cited in the aforementioned *Research Disclosure* (RD) No. 17643, sections VII-C–G.

Yellow couplers disclosed, for example, in U.S. Pat. Nos. 3,933,501, 4,022,620, 4,326,024, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred.

5-Pyrazolone based compounds and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO 88/04795 are particularly preferred.

In addition to the couplers represented by general formulae (I) and (C), preferred cyan couplers which can be used in the present invention include those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid Open 3,329,729, European Patents 121,365A and 249,453A, U.S. Pat. Nos. 3,446,622, 4,333,999, 4,775,616, 4,451,559, 4,427,767, 4,254,212 and 4,296,199, and JP-A-61-42658.

Typical examples of polymerized dye forming couplers have been disclosed, for example, in U.S. Pat. Nos. 3,451,820, 4,080,211, 4,367,282, 4,409,320 and 4,576,910, British Patent 2,102,137 and European Patent 341,188A.

The colored couplers for correcting the unnecessary absorptions of colored dyes disclosed, for example, in section VII-G of *Research Disclosure* No. 17643, U.S. Pat. Nos. 4,163,670, JP-B-57-39413, U.S. Pat. Nos. 4,004,929 and 4,138,258, and British Patent 1,146,368 can be used in addition to those represented by general formula (I) of the present invention. Furthermore, the use of couplers which correct the unnecessary absorption of colored dyes by means of fluorescent dyes which are released on coupling as disclosed in U.S. Pat. No. 4,774,181, and couplers which have, as leaving groups, dye precursor groups which can form dyes on reaction with the developing agent disclosed in U.S. Pat. No. 4,777,120 is also preferred.

The couplers disclosed in U.S. Pat. No. 4,366,237, British Patent 2,125,570, European Patent 96,570 and West German Patent (Laid Open) 3,234,533 are preferred as couplers of which the colored dyes have a suitable degree of diffusibility.

The use of couplers which release photographically useful residual groups on coupling is preferred in the present invention. The DIR couplers which release development inhibitors disclosed in the patents cited in section VII-F of the aforementioned *Research Disclosure* 17643, JP-A-57-151944, JP-A-57-154234, JP-A-60-184248, JP-A-63-37346, JP-A-63-37350 and U.S. Pat. Nos. 4,248,962 and 4,782,012 are preferred.

The couplers disclosed in British Patents 2,097,140 and 2,131,188, JP-A-59-157638 and JP-A-59-170840 are preferred as couplers which release nucleating agents or development accelerators in the form of the image during development.

Other compounds which can be used in the photographic materials of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release dyes of which the color is restored after elimination disclosed in European Patent 173,302A, the bleach accelerator releasing couplers disclosed, for example, in *Research Disclosure* No. 11449, ibid, No. 24241, and JP-A-61-201247, the ligand releasing couplers disclosed, for example, in U.S. Pat. 4,553,477, the leuco dye releasing couplers disclosed in JP-A-63-75747, and the couplers which release fluorescent dyes disclosed in U.S. Pat. No. 4,774,181.

The couplers which are used in the present invention can be introduced into the photographic material using a variety of known methods of dispersion.

Examples of high boiling point solvents which can be used in the oil in water dispersion method have been disclosed, for example, in U.S. Pat. No. 2,322,027.

Actual examples of high boiling point organic solvents which have a boiling point of at least 175° C. at normal pressure which can be used in the oil in water dispersion method include phthalic acid esters (for example, dibutyl phthalate, dicyclohexyl phthalate, di-2-ethylhexyl phthalate, decyl phthalate, bis(2,4-di-tert-amylphenyl)-phthalate, bis(2,4-di-tert-amylphenyl-)isophthalate and bis(1,1-diethylpropyl)phthalate), phosphate or phosphonate esters (for example, triphenyl phosphate, tricresyl phosphate, 2-ethylhexyl diphenyl phosphate, tricyclohexyl phosphate, tri-2-ethylhexyl phosphate, tridodecyl phosphate, tri-butoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecylpyrrolidone), alcohols or phenols (for example, iso-stearyl alcohol and 2,4-di-tert-amylphenol), aliphatic carboxylic acid esters (for example, bis(2-ethylhexyl) sebacate, dioctyl azelate, glycerol tributyrate, iso-stearyl lactate and trioctyl citrate), aniline derivatives (for example, N,N-dibutyl-2-butoxy-5-tert-octylaniline) and hydrocarbons (for example, paraffins, dodecylbenzene and di-isopropylnaphthalene). Furthermore, organic solvents which have a boiling point above about 30° C., and preferably of at least 50° C., but below about 160° C. can be used as auxiliary solvents, and typical examples of these solvents include ethyl acetate, butyl acetate, ethyl propionate, methyl ethyl ketone, cyclohexanone, 2-ethoxyethyl acetate and dimethylformamide.

Specific examples of the processes and effects of the latex dispersion method and of latexes for loading purposes have been disclosed, for example, in U.S. Pat. No. 4,199,363, and West German Patent Application (OLS) Nos. 2,541,274 and 2,541,230.

The addition to the color photosensitive materials of the present invention of various fungicides and bactericides such as 1,2-benzisothiazolin-3-one, n-butyl p-hydroxybenzoate, phenol, 4-chloro-3,5-dimethylphenol, 2-phenoxyethanol and 2-(4-thiazolyl)benzimidazole as disclosed in JP-A-63-257747, JP-A-62-272248 and JP-A-H1-80941 is preferred.

The present invention can be applied to a variety of color photosensitive materials. Typical examples include color negative films for general and cinematographic purposes, color reversal films for slides and television purposes, color papers, color positive films and color reversal papers.

Suitable supports which can be used in the present invention have been disclosed, for example, on page 28 of the aforementioned *Research Disclosure* No. 17643, and from the right hand column of page 647 to the left hand column of page 648 of *Research Disclosure* No. 18716.

The photosensitive materials of the present invention are such that the total film thickness of all the hydrophilic colloid layers on the side where the emulsion layers are located is preferably not more than 28 μm, more desirably not more than 23 μm, and most desirably not more than 18 μm. Furthermore, the film swelling rate $T_{\frac{1}{2}}$ is preferably not more than 30 seconds and most desirably not more than 20 seconds. Here, the film thickness signifies the film thickness measured under conditions of 25° C., 55% relative humidity (2 days) and the film swelling rate $T_{\frac{1}{2}}$ is that measured using the methods well known to those in the industry. For example, measurements can be made using a swellometer of the type described by A. Green in *Photogr. Sci. Eng.*, Volume 19, Number 2, pages 124–129, and $T_{\frac{1}{2}}$ is defined as the time taken to reach half the saturated film thickness, taking 90% of the maximum swelled film thickness reached on processing the material for 3 minutes 15 seconds in a color developer at 30° C. as the saturated film thickness.

The film swelling rate $T_{\frac{1}{2}}$ can be adjusted by adding film hardening agents for the gelatin which is used as a binder, or by changing the ageing conditions after coating. Furthermore, the swelling factor is preferably from 150% to 400%. The swelling factor can be calculated from the maximum swelled film thickness obtained under the conditions described above using the expression (maximum swelled film thickness minus film thickness)/film thickness.

Color photographic materials in accordance with the present invention can be developed and processed using the usual methods disclosed on pages 28–29 of the aforementioned *Research Disclosure* No. 17643 and from the left hand column to the right hand column of page 615 of the aforementioned *Research Disclosure* No. 18716.

The color developers used in the development processing of photosensitive materials of the present invention are preferably aqueous alkaline solutions which contain a primary aromatic amine based color developing agent as the principal component. Aminophenol based compounds are also useful as color developing agents, but the use of p-phenylenediamine based compounds is preferred, and typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethyl-aniline, 3-methyl-4-amino-N-ethyl-β-methoxyethylaniline, and the sulfate, hydrochloride and p-toluenesulfonate salts of these compounds. From among these compounds, 3-methyl-4-amino-N-ethyl-N-β-hydroxyethylaniline sulfate is especially desirable. Two or more of these compounds can be used conjointly, according to the intended purpose.

The color developer generally contains pH buffers such as alkali metal carbonates, borates or phosphates, and development inhibitors or anti-foggants such as chlorides, bromides, iodides, benzimidazoles, benzothiazoles or mercapto compounds. It may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by the aminopolycarboxylic acids, aminopolyphosphonic acids, alkylphosphonic acids and phosphonocarboxylic acids, typical examples of which include ethylenediamine tetra-acetic acid, nitrilotriacetic acid, diethylenetriamine penta-acetic acid, cyclohexanediamine tetra-acetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Furthermore, color development is carried out after a normal black and white development in the case of reversal processing. Known black and white developing agents including dihydroxybenzenes such as hydroquinone, 3-pyrazolidones such as 1-phenyl-3-pyrazolidone, and aminophenols such as p-aminophenol, for example, can be used individually, or in combinations, in the black and white developer.

The pH of these color developers and black and white developers is generally from 9 to 12. Furthermore, the replenishment rate for these developers depends on the color photographic photosensitive material which is being processed but in general is not more than 3 liters per square meter of photosensitive material and it can be set to not more than 500 ml by reducing the bromide ion concentration in the replenisher. In cases where the replenishment rate is low it is desirable that evaporation and aerial oxidation of the liquid should be prevented by minimizing the area of contact with the air in the processing tank.

The contact area between the air and the photographic processing bath in a processing tank can be represented by the open factor which is defined below. Thus:

$$\text{Open Factor} = \frac{\text{Air Contact Area of Processing Bath (cm}^2\text{)}}{\text{Processing Bath Volume (cm}^3\text{)}}$$

The above mentioned open factor is preferably less than 0.1, and most desirably from 0.001 to 0.05. As well as the establishment of a shielding material such as a floating lid on the surface of the photographic processing bath in the processing tank, the method involving the use of a movable lid as disclosed in JP-A-1-82033 and the method involving the slit development processing disclosed in JP-A-63-216050 can be used as means of reducing the open factor. Reduction of the open factor is preferably applied not only to the processes of color development and black and white development but also to all the subsequent processes, such as the bleaching, bleach-fixing, fixing, water washing and stabilizing processes. Furthermore, the replenishment rate can be reduced by using some means of suppressing the accumulation of bromide ion in the development bath.

The color development processing time is generally established between 2 and 5 minutes, but shorter processing times can be devised by increasing the pH or by increasing the concentration of the color developing agent.

The photographic emulsion layer is generally subjected to a bleaching process after color development. The bleaching process may be carried out at the same time as a fixing process (in a bleach-fix process) or it may be carried out as a separate process. Moreover, a bleach-fix process can be carried out after a bleaching process in order to speed up processing. Moreover, processing can be carried out in two connected bleach-fix baths, a fixing process can be carried out before a bleach-fixing process or a bleaching process can be carried out after a bleach-fix process, as required. Compounds of multi-valent metals, such as iron(III) for example, peracids, quinones and nitro compounds can be used as bleaching agents. Typical bleaching agents include organic complex salts of iron(III), for example, complex salts with aminopolycarboxylic acids such as ethylenediamine tetra-acetic acid, diethylenetriamine penta-acetic acid, cyclohexanediamine tetra-acetic acid, methylimino diacetic acid, 1,3-diaminopropane tetra-acetic acid and glycol ether diamine tetra-acetic acid, or citric acid, tartaric acid or malic acid. Of these materials, the use of polyaminocarboxylic acid iron(III) complex salts, principally ethylenediamine tetra-acetic acid iron(III) complex salts and 1,3-diaminopropane tetra-acetic acid iron(III) salts, is preferred from the points of view of both rapid processing and the prevention of environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is generally from 4.0 to 8, but lower pH values can be used in order to speed up processing.

Bleaching accelerators can be used, as required, in the bleach baths, bleach-fix baths or bleach or bleach-fix pre-baths. Specific examples of useful bleach accelerators have been disclosed in the following specifications. Thus, there are the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure* No. 17129 (Jun. 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-40943, JP-A-49-59644, JP-A-53-94927, JP-A-54-35727, JP-A-55-26506 and JP-A-58-163940; and the bromide ion. From among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may also be added to the photographic materials. These bleaching accelerators are especially effective when bleach-fixing camera color photosensitive materials.

The inclusion of organic acids as well as the compounds indicated above in the bleach baths and bleach-fix baths is desirable for preventing the occurrence of bleach staining. Compounds which have an acid dissociation constant (pKa) of from 2 to 5 are especially desirable as organic acids, and in practice acetic acid and propionic acid, for example, are preferred.

Thiosulfate, thiocyanate, thioether based compounds, thioureas and large amounts of iodide can be used, for example, as the fixing agent which is used in a fixing bath or bleach-fix bath, but thiosulfate is generally used, and ammonium thiosulfate in particular can be used in the widest range of applications. Furthermore, the conjoint use of thiosulfate and thiocyanate, thioether compounds, thiourea etc. is also desirable. Sulfite, bisulfite, carbonyl/bisulfite addition compounds or the sulfinic acid compounds disclosed in European Patent 294,769A are preferred as preservatives for fixing baths and bleach-fix baths. Moreover, the addition of various aminopolycarboxylic acids and organophosphonic acids to the fixing baths and bleach-fixing baths is desirable for stabilizing these baths. The total time of the de-silvering process is preferably as short as possible within the range where de-silvering failure does not occur. The preferred de-silvering time is from 1 to 3 minutes, and most desirably the de-silvering time is from 1 to 2 minutes. Furthermore, the processing temperature is from 25° C. to 50° C., and preferably from 35° C. to 45° C. The desilvering rate is improved and the occurrence of staining after processing is effectively prevented within the preferred temperature range.

The de-silvering baths are preferably agitated as strongly as possible during the de-silvering process. Actual examples of methods of strong agitation include the methods in which a jet of processing bath is made to impinge on the emulsion surface of the photosensitive material as disclosed in JP-A-62-183460, the methods in which the agitation effect is increased using a rotary device as disclosed in JP-A-62-183461, the methods in which the photosensitive material is moved with a wiper blade which is established in the bath in contact with the emulsion surface and the agitation effect is increased by the generation of turbulence at the emulsion surface, and the methods in which the circulating flow rate of the processing bath as a whole is increased. These means of increasing agitation are effective in bleach baths, bleach-fix baths and fixing baths. It is thought that increased agitation increases the rate of supply of bleaching agent and fixing agent to the emulsion film and consequently increases the de-silvering rate. Furthermore, the aforementioned means of increasing agitation are more effective in cases where a bleaching accelerator is being used, and they sometimes provide a marked increase in the accelerating effect and eliminate the fixer inhibiting action of the bleaching accelerator.

The automatic processors used for photosensitive materials of the present invention preferably have photosensitive material transporting devices as disclosed in JP-A-60-191257, JP-A-60-191258 or JP-A-60-191259. With such a transporting device, such as that disclosed in the aforementioned JP-A-60-191257, the carry over of processing bath from one bath to the next is greatly reduced and this is very effective for preventing deterioration in processing bath performance. These effects are especially useful for shortening the processing time in each process and for reducing the replenishment rate of each processing bath.

The silver halide color photographic materials of the present invention are generally subjected to a water washing process and/or stabilizing process after the de-silvering process. The amount of wash water used in the washing process can be fixed within a wide range, depending on the application and the nature (depending on the materials such as couplers which have been used for example) of the photosensitive material, the wash water temperature, the number of water washing tanks (the number of water washing stages) and the replenishment system, i.e. whether a counter flow or a sequential flow system is used, and various other conditions. The relationship between the amount of water used and the number of washing tanks in a multi-stage counter-flow system can be obtained using the method outlined on pages 248–253 of the *Journal of the Society of Motion Picture and Television Engineers,* Volume 64 (May 1955).

The amount of wash water used can be greatly reduced by using the multi-stage counter-flow system noted in the aforementioned literature, but bacteria proliferate due to the increased residence time of the water in the tanks and problems arise with the suspended matter which is produced becoming attached to the photosensitive material. The method in which the calcium ion and magnesium ion concentrations are reduced, as disclosed in JP-A-62-288838, is very effective as a means of overcoming this problem when processing color photosensitive materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in *The Chemistry of Biocides and Fungicides* by Horiguchi, (1986, Sanko Shuppan), in *Killing Micro-organisms, Biocidal and Fungicidal Technicues* (1982) published by the Health and Hygiene Technology Society, and in *A Dictionary of Biocides and Fungicides* (1986) published by the Japanese Biocide and Fungicide Society, can also be used in this connection.

The pH value of the washing water when processing photosensitive materials of the present invention is from 4 to 9, and preferably from 5 to 8. The washing water temperature and the washing time can be set variously in accordance with the nature and application of the photosensitive material but, in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can be used for a stabilization process of this type.

Furthermore, in some cases a stabilization process is carried out following the aforementioned water washing process, and the stabilizing baths which contain dye stabilizing agents and surfactants which are used as final baths with camera color photosensitive materials are an example of such a process. Aldehydes such as formalin and glutaraldehyde, N-methylol compounds, hexamethylenetetramine and aldehyde/bisulfite addition compounds can be used, for example, as dye stabilizing agents.

Various chelating agents and fungicides can also be added to these stabilizing baths.

The overflow which accompanies replenishment of the above mentioned water washing or stabilizing baths can be reused in other processes, such as the de-silvering process for example.

Concentration correction with the addition of water is desirable in cases where the above mentioned processing baths become concentrated due to evaporation when processing in an automatic processor for example.

Color developing agents can be incorporated into a silver halide color photosensitive material of the present invention with a view to simplifying and speeding up processing. The incorporation of various color developing agent precursors is preferred. For example, the indoaniline based compounds disclosed in U.S. Pat. No. 3,342,597, the Shiff's base type compounds disclosed in U.S. Pat. No. 3,342,599, *Research Disclosure* No. 14850 and ibid, No. 15159, the aldol compounds disclosed in *Research Disclosure* No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be incorporated, as required, into a silver halide color photosensitive material of the present invention with a view to accelerating color development. Typical compounds have been disclosed, for example, in JP-A-56-64339, JP-A-57-144547 and JP-A-58-115438.

The various processing baths in the present invention are used at a temperature of from 10° C. to 50° C. The standard temperature is generally from 33° C. to 38° C., but accelerated processing and shorter processing times can be realized at higher temperatures while, on the other hand, increased picture quality and better processing bath stability can be achieved at lower temperatures.

Furthermore, the silver halide photosensitive materials of the present invention can be used as the heat developable photosensitive materials disclosed, for example, in U.S. Pat. No. 4,500,626, JP-A-60-133449, JP-A-59-218443, JP-A-61-238056 and European Patent 210,660A2.

The present invention is described in more detail below by the following examples, but the present invention is not limited thereto.

EXAMPLE 1

Sample 101 was prepared by coating each of the layers of which the composition is described below onto a triacetylcellulose film support on which an under-layer had been established.

| | |
|---|---|
| (1) Emulsion Layer | |
| Tabular emulsion (0.6 mol. % AgI, average aspect ratio 7.5, average grain diameter 0.75 μm) as silver | 1.70 g/m$^2$ |
| Coupler (C-30) | 0.75 g/m$^2$ |
| Tricresyl phosphate | 0.40 g/m$^2$ |
| Gelatin | 2.80 g/m$^2$ |
| (2) Protective Layer | |
| 2,4-Dichloro-6-hydroxy-s-triazine, sodium salt | 0.10 g/m$^2$ |
| Gelatin | 1.8 g/m$^2$ |

Sample 102

Sample 102 was prepared in the same way except that the comparative colored coupler R-1 was added in an amount of 0.08 g/m$^2$ to the emulsion layer of Sample 101.

Samples 103–107

Samples 103–107 were prepared by replacing R-1 in Sample 102 with an equimolar amount of other couplers as shown in Table 1.

Sample 108

Sample 108 was prepared by excluding the tricresyl phosphate from the emulsion layer of Sample 104.

Samples 109–111

These were prepared by replacing the coupler C-30 in sample 108 with equimolar amounts of C-7/C-30 (3/1), C-7/C-10 (2/1) and C-10 respectively.

Samples 112, 113

In Samples 112 and 113, the colored coupler of sample 111 was replaced with an equimolar amount of (I-2) and (I-15), respectively.

These samples were subjected to a red light exposure for sensitometric purposes and developed and processed as described below. The cyan and yellow densities of the developed samples were measured and the relative sensitivities were obtained in terms of the logarithm of the reciprocal of the exposure amount which gave a cyan density of (fog+0.2) and the color turbidity was obtained as the yellow density at the exposure which gave a cyan density of 1.0.

The color development processing was carried out at 38° C. under the conditions indicated below.

| | |
|---|---|
| 1. Color Development | 2 minutes 15 seconds |
| 2. Bleaching | 6 minutes 30 seconds |
| 3. Water Washing | 3 minutes 15 seconds |
| 4. Fixing | 6 minutes 30 seconds |
| 5. Water Washing | 3 minutes 15 seconds |
| 6. Stabilizing | 3 minutes 15 seconds |

The composition of the processing bath used in each process was as follows:

| | |
|---|---|
| Color Development Bath | |
| Nitrilotriacetic acid | 1.0 gram |
| Sodium sulfite | 4.0 grams |
| Sodium carbonate | 30.0 grams |
| Potassium bromide | 1.4 grams |
| Hydroxylamine sulfate | 2.4 grams |
| 4-(N-Ethyl-N-B-hydroxyethylamino)-2-methylaniline sulfate | 4.5 grams |
| Water to make up to | 1 liter |
| Bleach bath | |
| Ammonium bromide | 160.0 grams |
| Aqueous ammonia (28%) | 25.0 ml |
| Ethylene diamine tetra-acetic acid, sodium iron salt | 130 grams |
| Glacial acetic acid | 14 ml |
| Water to make up to | 1 liter |
| Fixer Bath | |
| Sodium tetrapolyphosphate | 2.0 grams |
| Sodium sulfite | 4.0 grams |
| Ammonium thiosulfate (70%) | 175.0 ml |
| Sodium bisulfite | 4.6 grams |
| Water to make up to | 1 liter |
| Stabilizer | |
| Formalin | 2.0 ml |
| Water to make up to | 1 liter |

TABLE 1

| Sample | Emulsion Layer Coupler | Emulsion Layer Colored Coupler | Relative Sensitivity | Color Turbidity |
|---|---|---|---|---|
| 101 (Comp. Ex.) | C-30 | — | 0.00 | 0.21 |
| 102 (Comp. Ex.) | C-30 | R-1 | +0.01 | 0.13 |
| 103 (Comp. Ex.) | C-30 | R-2 | −0.03 | 0.18 |
| 104 (Invention) | C-30 | (I-1) | +0.02 | 0.06 |
| 105 (Invention) | C-30 | (I-4) | +0.01 | 0.07 |
| 106 (Invention) | C-30 | (I-13) | +0.03 | 0.05 |
| 107 (Invention) | C-30 | (I-14) | +0.03 | 0.05 |
| 108 (Invention) | C-30 | (I-1) | +0.02 | 0.05 |
| 109 (Invention) | C-7/C-30 | (I-1) | +0.02 | 0.05 |
| 110 (Invention) | C-7/C-30 | (I-1) | +0.02 | 0.05 |
| 111 (Invention) | C-10 | (I-1) | +0.01 | 0.06 |
| 112 (Invention) | C-10 | (I-2) | +0.03 | 0.04 |
| 113 (Invention) | C-10 | (I-15) | +0.01 | 0.05 |

It is clear from Table 1 that the samples in which a coupler of the present invention was used had a lower color turbidity and better color reproduction without loss of speed when compared with samples in which couplers of the present invention were not used.

EXAMPLE 2

Sample 201, a multi-layer color photosensitive material, was prepared by the lamination coating of each of the layers of which the compositions are indicated below on a triacetylcellulose film support on which an under-layer had been established.

Composition of the Photosensitive Layer

The numerical value corresponding to each component indicates the coated weight in units of g/m$^2$. In the case of silver halides this is shown as the coated weight calculated as silver. Furthermore, with the sensitizing dyes the coated weights are shown in units of mol per mol of silver halide in the same layer.

Sample 201

| | |
|---|---|
| First Layer Anti-halation Layer | |
| Black colloidal silver as silver | 0.18 |
| Gelatin | 0.40 |
| Second Layer Intermediate Layer | |
| 2,5-Di-tert-pentadecylhydroquinone | 0.18 |
| EX-1 | 0.07 |
| EX-2 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Third Layer First Red Sensitive Emulsion Layer | |
| Mono-disperse silver iodobromide emulsion (10 mol. % AgI, average grain size 0.7 μm, variation coefficient for grain size 0.16) as silver | 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.150 |
| EX-10 | 0.020 |
| Gelatin | 0.45 |
| Fourth Layer Second Red Sensitive Emulsion Layer | |
| Tabular silver iodobromide emulsion (12 mol. % AgI, average grain diameter 0.7 μm, average aspect ratio 5.5, average thickness 0.2 μm) as silver | 1.0 |
| Sensitizing dye IX | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| EX-2 | 0.400 |
| EX-3 | 0.012 |
| EX-10 | 0.015 |
| Gelatin | 1.30 |
| Fifth Layer Third Red Sensitive Emulsion Layer | |
| Silver iodobromide emulsion (16 mol. % AgI, average grain size 1.1 μm) as silver | 1.60 |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| EX-10 | 0.007 |
| EX-3 | 0.045 |
| EX-4 | 0.120 |
| HBS-1 | 0.22 |
| HBS-2 | 0.10 |
| Gelatin | 1.63 |
| Sixth Layer Intermediate Layer | |
| EX-5 | 0.040 |
| HBS-1 | 0.020 |
| Gelatin | 0.80 |
| Seventh Layer First Green Sensitive Emulsion Layer | |
| Tabular silver iodobromide emulsion (12 mol. % AgI, average grain diameter 0.6 μm, average aspect ratio 6.0, average grain thickness 0.15 μm) as silver | 0.40 |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-11 | 0.010 |
| Gelatin | 0.75 |
| Eighth Layer Second Green Sensitive Emulsion Layer | |
| Mono-disperse silver iodobromide emulsion (20 mol. % AgI, average grain size 0.7 μm, variation coefficient of grain size 0.17) as silver | 0.80 |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-11 | 0.008 |
| Gelatin | 1.10 |
| Ninth Layer Third Green Sensitive Emulsion Layer | |
| Silver iodobromide emulsion (14 mol. % AgI, average grain size 1.0 μm,) as silver | 1.2 |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |
| EX-11 | 0.030 |
| EX-1 | 0.025 |
| HBS-1 | 0.25 |
| EX-10 | 0.010 |
| Gelatin | 1.10 |
| Tenth Layer Yellow Filter Layer | |
| Yellow colloidal silver as silver | 0.05 |
| EX-5 | 0.08 |
| HBS-1 | 0.03 |
| Gelatin | 0.50 |
| Eleventh Layer First Blue Sensitive Emulsion Layer | |
| Tabular silver iodobromide emulsion (4 mol. % AgI, average grain diameter 0.6 μm, average aspect ratio 7.3, average grain thickness 0.14 μm) as silver | 0.24 |
| Sensitizing dye VIII | $3.4 \times 10^{-4}$ |
| EX-9 | 0.85 |
| EX-8 | 0.059 |
| HBS-1 | 0.28 |
| Gelatin | 1.50 |
| Twelfth Layer Second Blue Sensitive Emulsion Layer | |
| Mono-disperse silver iodobromide emulsion (20 mol. % AgI, average grain size 0.8 μm, variation coefficient of grain size 0.18) as silver | 0.45 |
| Sensitizing dye VIII | $2.1 \times 10^{-4}$ |
| EX-9 | 0.20 |
| EX-10 | 0.015 |
| HBS-1 | 0.03 |
| Gelatin | 0.45 |
| Thirteenth Layer Third Blue Sensitive Emulsion Layer | |
| Silver iodobromide emulsion (14 mol. % AgI, average grain size 1.3 μm) as silver | 0.77 |
| Sensitizing dye VIII | $2.2 \times 10^{-4}$ |
| EX-9 | 0.20 |
| EX-10 | 0.005 |
| HBS-1 | 0.07 |
| Gelatin | 0.69 |
| Fourteenth Layer First Protective Layer | |
| Silver iodobromide emulsion (2 mol. % AgI, average grain size 0.07 μm) as silver | 0.5 |

-continued

| | |
|---|---|
| U-4 | 0.11 |
| U-5 | 0.17 |
| HBS-1 | 0.90 |
| Gelatin | 0.60 |
| Fifteenth Layer Second Protective Layer | |
| Poly(methyl acrylate) particles (diameter about 1.5 μm) | 0.54 |
| S-1 | 0.15 |
| S-2 | 0.05 |
| Gelatin | 0.72 |

As well as the components indicated above, gelatin hardening agent H-1, surfactant, benzisothiazoline (average 200 ppm with respect to the gelatin), n-butyl-p-hydroxybenzoate (average 500 ppm with respect to the gelatin) and phenoxyethanol (average 1000 ppm with respect to gelatin) were added to each layer.

Sample 202

Sample 202 was prepared by replacing the colored coupler EX-3 added to the fourth and fifth layers of sample 201 with an equimolar amount of coupler (I-1) of the present invention.

Sample 203

Sample 203 was prepared by replacing EX-2 which was added to the third, fourth and fifth layers of sample 201 with an equimolar amount of the cyan coupler C-7 which is preferably used in the present invention and by replacing the EX-4 in the fifth layer with an equimolar amount of C-34.

Samples 204–208

Samples 204–208 were prepared by replacing the colored coupler EX-3 added to the fourth and fifth layers of sample 203 with an equimolar amount of the coupler (I-1), (I-2), (I-13), (I-14) or (1-15), respectively, of the present invention.

These samples were subjected to a red light image-wise exposure and color developed in the way outlined below, after which the relative speeds and color turbidities were obtained. The relative speed is indicated as the relative value of the logarithm of the reciprocal of the exposure which provided a cyan density of (fog+0.2), taking the value for sample 201 to be zero. The color turbidity is the value obtained by subtracting the yellow fog density from the yellow density at the point at which the cyan density is (fog+1.5).

Furthermore, the processed samples were left to stand for 2 days under conditions of 80° C., 70% relative humidity and then the cyan densities were measured again. The results are shown in Table 2 as the density after enforced deterioration at a point where the initial cyan density was 1.00.

The color development processing was carried out at 38° C. in the way indicated below using an automatic processor.

| | | |
|---|---|---|
| Color Development | 3 minutes | 15 seconds |
| Bleaching | 1 minute | |
| Bleach-fixing | 3 minutes | 15 seconds |
| Water wash (1) | | 40 seconds |
| Water wash (2) | 1 minute | |
| Stabilizing | | 40 seconds |
| Drying (50° C.) | 1 minute | 15 seconds |

A counter-current water washing system from water wash (2) to water wash (1) was used for water washes (1) and (2) in the processing operations indicated above.

Moreover, the replenishment rate was 1200 ml per square meter of color photosensitive material in the case of color development and 800 ml per square meter of photosensitive material for all of the other processes, including the water wash. Furthermore, the carry over from the previous bath into the water washing process was 50 ml per square meter of photosensitive material.

| | Parent Bath | Replenisher |
|---|---|---|
| Color Development Bath | | |
| Diethylenetriamine penta-acetic acid | 1.0 gram | 1.1 grams |
| 1-Hydroxyethylidene-1,1-diphosphonic acid | 2.0 grams | 2.2 grams |
| Sodium sulfite | 4.0 grams | 4.4 grams |
| Potassium carbonate | 30.0 grams | 32.0 grams |
| Potassium bromide | 1.4 grams | 0.7 gram |
| Potassium iodide | 1.3 mg | — |
| Hydroxylamine sulfate | 2.4 grams | 2.6 grams |
| 4-(N-Ethyl-N-β-hydroxyethyl-amino)-2-methylaniline sulfate | 4.5 grams | 5.0 grams |
| Water to make up to | 1.0 liter | 1.0 liter |
| pH | 10.0 | 10.5 |
| Bleach Bath (Parent Bath = Replenisher) | | |
| Ethylenediamine tetra-acetic acid, ferric ammonium salt | | 120.0 grams |
| Ethylenediamine tetra-acetic acid, di-sodium salt | | 10.0 grams |
| Ammonium nitrate | | 10.0 grams |
| Ammonium bromide | | 100.0 grams |
| Bleach accelerator | | $5 \times 10^{-3}$ mol |

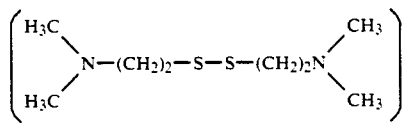

| | |
|---|---|
| Aqueous ammonia to pH | 6.3 |
| Water to make up to | 1 liter |
| Bleach-fix Bath (Parent Bath = Replenisher) | |
| Ethylenediamine tetra-acetic acid, ferric ammonium salt | 50.0 grams |
| Ethylene diamine tetra-acetic acid, di-sodium salt | 5.0 grams |
| Sodium sulfite | 12.0 grams |
| Aqueous ammonium thiosulfate solution (70%) | 240 ml |
| Aqueous ammonia to pH | 7.3 |
| Water to make up to | 1 liter |

Washing Water

Town water containing 32 mg/l of calcium ion and 7.3 mg/l of magnesium ion was passed through a column which had been packed with an H-type strongly acidic cation exchange resin and an OH-type strongly basic anion exchange resin and sodium isocyanurate dichloride was added at a rate of 20 mg per liter to the treated water which contained 1.2 mg/l of calcium ion and 0.4 mg/l of magnesium ion for use.

| Stabilizing Bath (Parent Bath = Replenisher) | |
|---|---|
| Formalin (37% w/v) | 2.0 ml |
| Polyoxyethylene p-monononylphenyl ether (average degree of polymerization 10) | 0.3 gram |
| Ethylenediamine tetra-acetic acid, di-sodium salt | 0.05 gram |
| Water to make up to | 1 liter |

-continued

| Stabilizing Bath (Parent Bath = Replenisher) | |
|---|---|
| pH | 5.8 |

Drying Drying temperature: 50° C.

It is clear from Table 2 that the samples of the present invention had low color turbidity and that the decrease in the cyan image density under enforced deterioration conditions was slight.

The compounds used in illustrative Examples 1 and 2 are shown below.

TABLE 2

| Sample | Colored Coupler (Layer 4, 5) | Non-colored Coupler (Layer 3, 4, 5) | Non-colored Coupler (Layer 5) | Relative Sensitivity | Color Turbidity | Density after Enforced Deterioration |
|---|---|---|---|---|---|---|
| 201 (Comp. Ex.) | EX-3 | EX-2 | EX-4 | 0.00 | 0.10 | 0.83 |
| 202 (Invention) | (I-1) | EX-2 | EX-4 | 0.01 | −0.01 | 0.94 |
| 203 (Comp. Ex.) | EX-3 | C-7 | C-34 | 0.00 | 0.15 | 0.94 |
| 204 (Invention) | (I-1) | C-7 | C-34 | 0.00 | 0.03 | 0.99 |
| 205 (Invention) | (I-2) | C-7 | C-34 | 0.00 | 0.02 | 1.00 |
| 206 (Invention) | (I-3) | C-7 | C-34 | +0.01 | 0.02 | 1.01 |
| 207 (Invention) | (I-14) | C-7 | C-34 | +0.01 | 0.02 | 1.01 |
| 208 (Invention) | (I-15) | C-7 | C-34 | −0.01 | 0.04 | 0.99 |

U-1

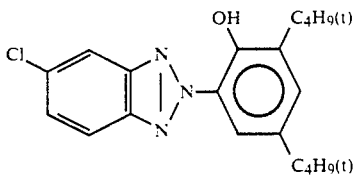

U-2

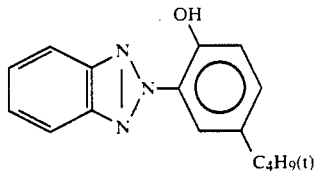

U-3

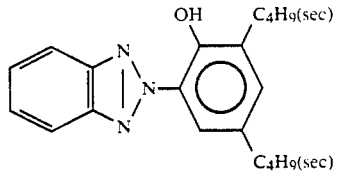

U-4

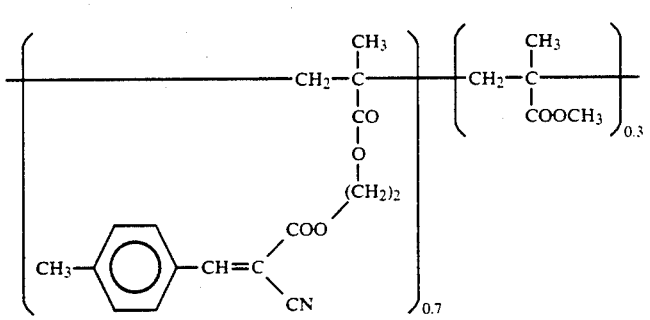

U-5

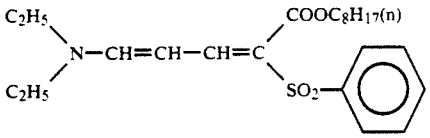

-continued
EX-1
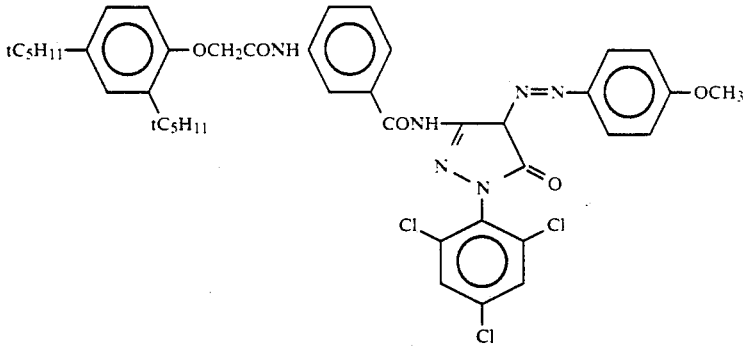
EX-2
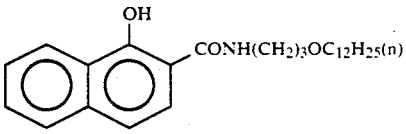
(Coupler 4 of JP-A-61-273543)
EX-3
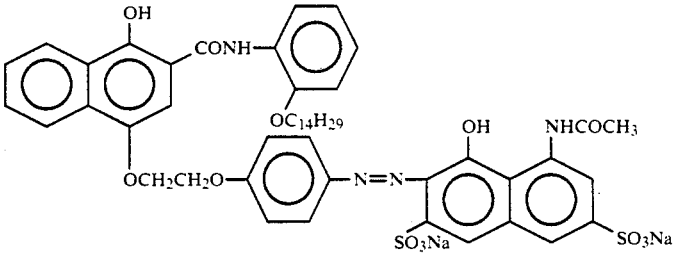
EX-4
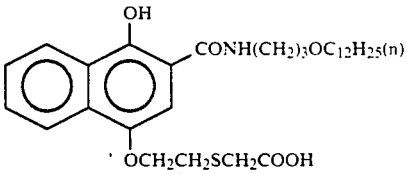
EX-5
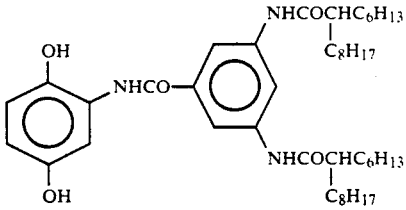
EX-6
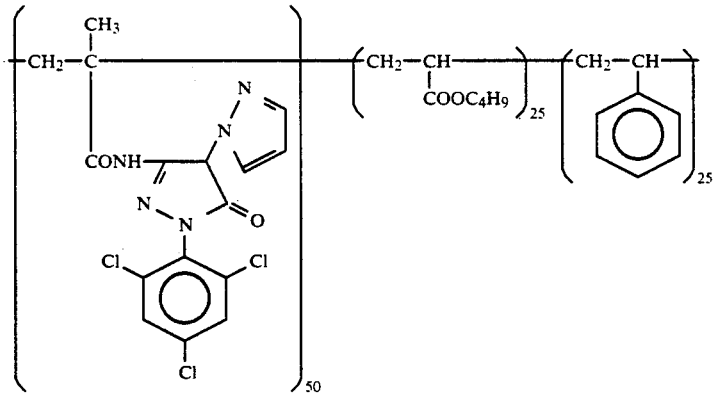
Ave. Mol. Wt. 30,000

-continued
EX-7
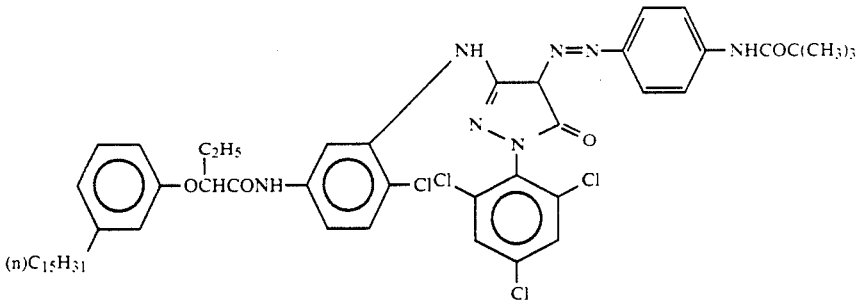
EX-8
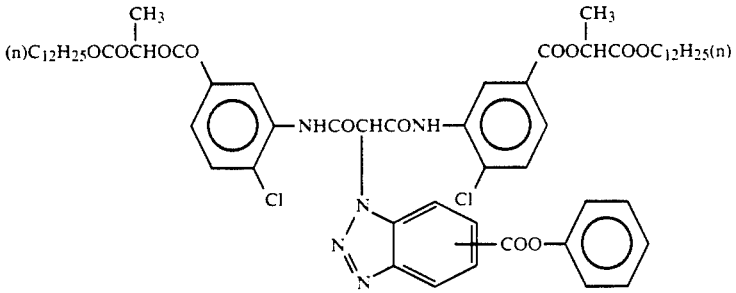
EX-9
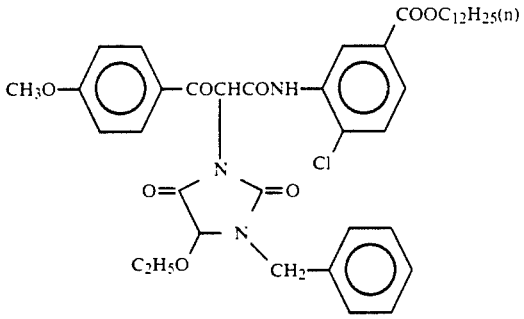
EX-10
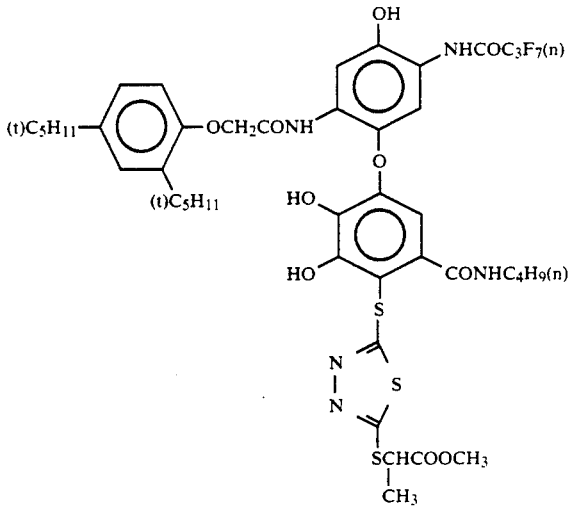

-continued
EX-11
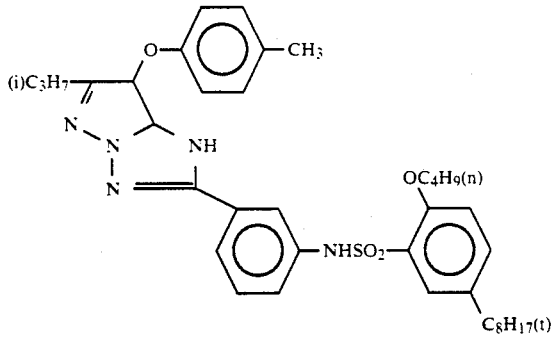
EX-12
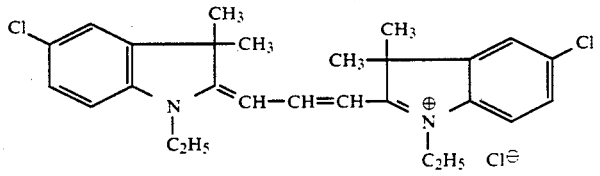
S-1
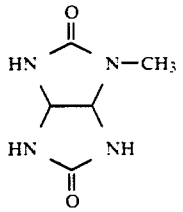
S-2
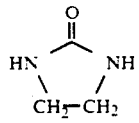
Tricresyl phosphate HBS-1
Dibutyl phthalate HBS-2
HBS-11
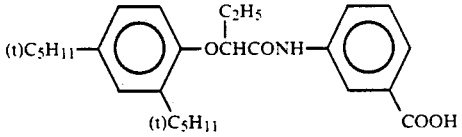
H-1
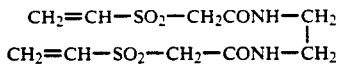
Sensitizing Dyes
I
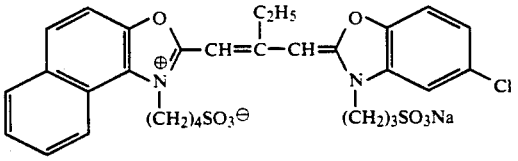
II
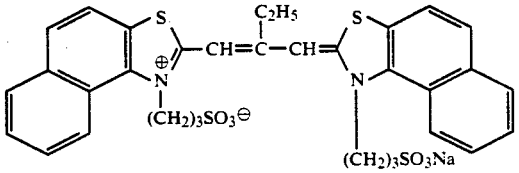

-continued
III
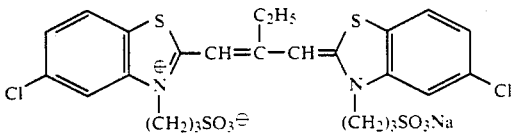
IV
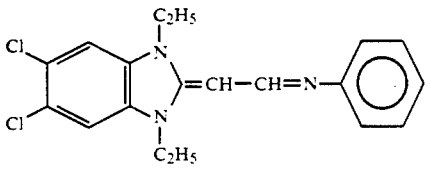
V
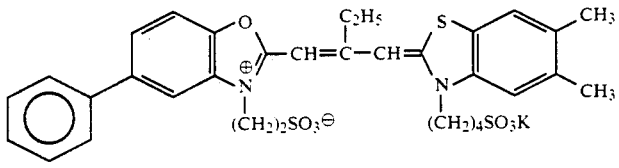
VI
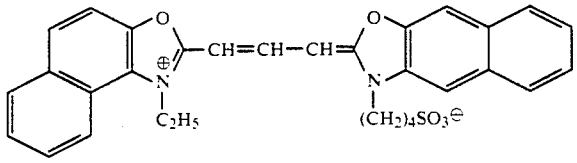
VII
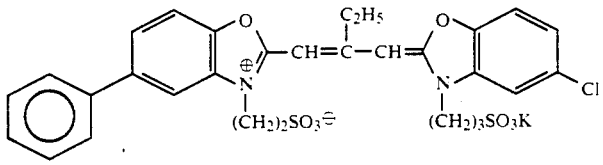
VIII
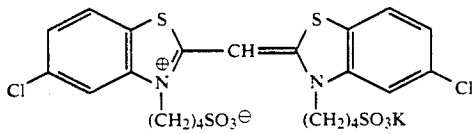
IX
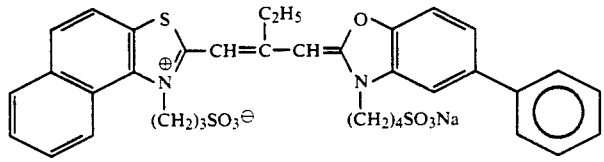
(C-15 of JP-A-61-221748)
R-1
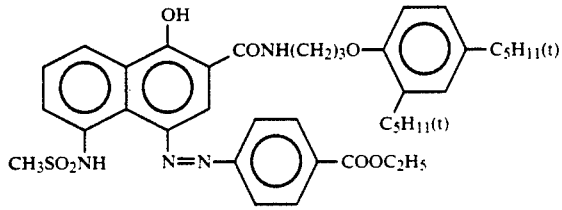
(C-17 of JP-A-61-221748)

-continued

R-2

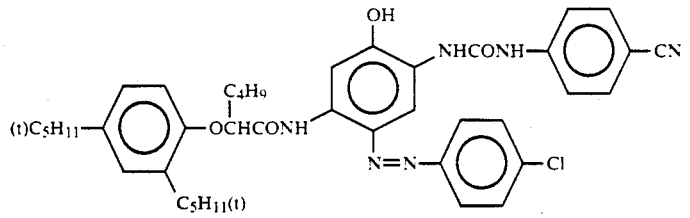

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer and at least one cyan coupler which can release a water-soluble compound residual group which contains a 2-acylaminophenylazo group or 2-sulfonamidophenylazo group via a coupling reaction with an oxidation product of a primary aromatic amine developing agent, wherein the cyan coupler is represented by the following general formula (I):

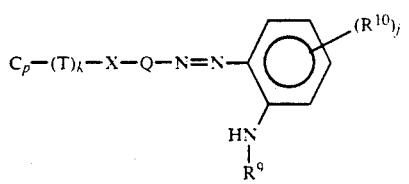

(I)

wherein $C_p$ represents a cyan coupler residue; T represents a timing group; k represents an integer of 0 or 1; X represents a divalent linking group which contains an N, O or S atom and which is bonded to $(T)_k$ by this atom; Q represents an arylene group or a divalent heterocyclic group; $R^9$ represents an acyl group or a sulfonyl group; $R^{10}$ represents a substituent group; and j represents an integer of from 0 to 4; provided that when j is an integer of 2 or more, than $R^{10}$ groups may be the same or different; and that at least one of the groups T, X, Q, $R^9$ or $R^{10}$ contains a water soluble group.

2. A silver halide color photographic material as claimed in claim 1, wherein the cyan coupler residual group Cp is represented by the following general formulas (Cp-1), (Cp-2), or

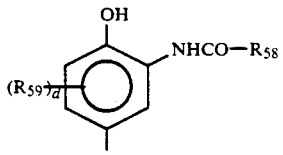

(Cp-1)

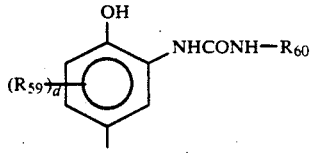

(Cp-2)

-continued

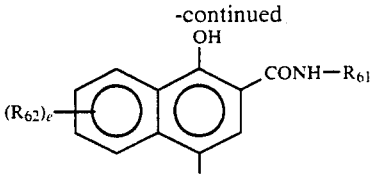

(Cp-3)

wherein $R_{41}$ represents an aliphatic group, an aromatic group or a heterocyclic group, $R_{42}$ represents an aromatic group or a heterocyclic group, and $R_{43}$, $R_{44}$ and $R_{45}$ represent independently a hydrogen atom, an aliphatic group, an aromatic group or a heterocyclic group;

$R_{58}$ represents an $R_{41}$- group;

$R_{59}$ represents an $R_{41}$- group, an $R_{41}CON(R_{43})$— group, an $R_{41}OCON(R_{43})$— group, an $R_{41}SO_2N(R_{43})$— group, an —$R_{43}NCON(R_{44})(R_{45})$— group, an $R_{41}O$- group, an $R_{42}S$- group, a halogen atom, or an $R_{41}N(R_{43})$— group;

d represents an integer of from 0 to 3, and when d is 2 or 3, the plurality of $R_{59}$ groups may be the same or different, and may be joined with a divalent group to form a ring structure;

$R_{60}$ and $R_{61}$ each represents an $R_{41}$- group;

$R_{62}$ represents an $R_{41}$-group, and $R_{41}CONH$- group, an $R_{41}OCONH$- group, an $R_{41}SO_2NH$- group, an $R_{43}NCON(R_{44})(R_{45})$— group, an $R_{43}NSO_2N(R_{44})(R_{45})$— group, an $R_{43}O$- group, an $R_{41}S$- group, a halogen atom or an $R_{41}N(R_{43})$— group;

and e represents an integer of from 0 to 4, provided that, when there is a plurality of $R_{62}$ groups, these groups may be the same or different.

3. A silver halide color photographic material as claimed in claim 1, wherein the timing group T is represented by the following general formulas (T-1), (T-2), (T-3), (T-4), (T-5), or (T-6):

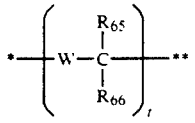

(T-1)

*-Nu-Link-E—** (T-2)

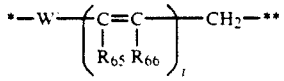

(T-3)

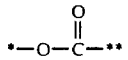

(T-4)

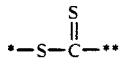

(T-5)

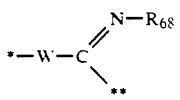

(T-6)

wherein W represents an oxygen atom, a sulfur atom or an

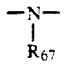

group, $R_{65}$ and $R_{66}$ represent hydrogen atoms or substituent groups, $R_{67}$ represents a substituent group, and t represents 1 or 2, provided that when t is 2, the two

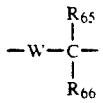

groups may be the same or different;

Nu represents a nucleophilic group; E represents an electrophilic group; and Link is a linking group enabling Nu and E to have a steric arrangement such that an intramolecular nucleophilic substitution reaction can occur;

and $R_{68}$ represents an $R_{67}$ group.

4. A silver halide color photographic material as claimed in claim 1, wherein the divalent linking group X is represented by the following general formula (II):

$$*\text{-}X_1\text{-}(L\text{-}X_2)_m\text{-}** \quad \text{(II)}$$

wherein * signifies the position which is bonded to $(T)_k$, ** signifies the position which is bonded to Q, $X_1$ represents —O— or —S—, L represents an alkylene group, $X_2$ represents a single bond, —O—, —S—, —CO—, —$SO_2$—

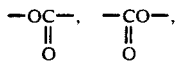

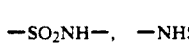

-continued

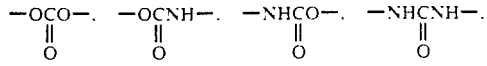

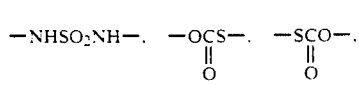

—$OSO_2NH$— or —$NHSO_2O$—, and m represents an integer of from 0 to 3.

5. A silver halide photographic material comprising a support having thereon at least one red sensitive emulsion layer, wherein the red sensitive emulsion layer or a layer adjacent thereto includes at least one cyan coupler which can release a water soluble compound residual group which contains a 2-acylaminophenylazo group or 2-sulfonamidophenylazo group by means of a coupling reaction with an oxidation product of a primary aromatic amine developing agent, wherein the cyan coupler is represented by the following general formula (I):

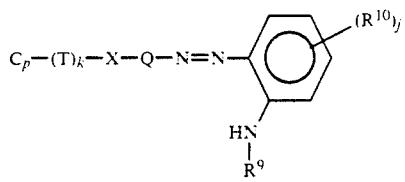

(I)

wherein $C_p$ represents a cyan coupler residue; T represents a timing group; k represents an integer of 0 or 1; X represents a divalent linking group which contains an N, O or S atom and which is bonded to $(T)_k$ by this atom; Q represents an arylene group or a divalent heterocyclic group; $R^9$ represents an acyl group or a sulfonyl group; $R^{10}$ represents a substituent group; and j represents an integer of from 0 to 4; provided that when j is an integer of 2 or more, the $R^{10}$ groups may be the same or different; and that at least one of the groups T, X, Q, $R^9$ or $R^{10}$ contains a water soluble group, and wherein the red sensitive layer contains a cyan color forming coupler represented by the general formula (C):

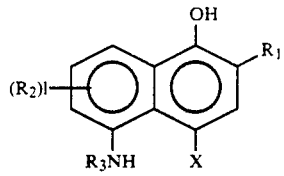

(C)

wherein $R_1$ represents —$CONR_4R_5$, —$SO_2NR_4R_5$, —$NHCOR_4$, —$NHCOOR_6$, —$NHSO_2R_6$, —$NHCONR_4R_5$ or —$NHSO_2NR_4R_5$; $R_2$ represents a group which can be substituted on a naphthalene ring; l represents an integer of value from 0 to 3; $R_3$ represents a substituent group X represents a hydrogen atom or a group which can be eliminated by a coupling reaction with an oxidation product of a primary aromatic amine developing agent; $R_4$ and $R_5$, which may be the same or different, each represents a hydrogen atom, an alkyl group, an aryl group or a heterocyclic group; and $R_6$ represents an alkyl group, an aryl group, or a heterocyclic group; provided, that when l represents 2 or 3, the $R_2$ groups may be the same or different, or the groups may be joined together to form a ring; that $R_2$ and $R_3$, or $R_3$ and X, may be joined together to form a ring; and that dimers or larger oligomers may be formed by joining together via divalent groups or groups of valency greater than two in $R_1$, $R_2$, $R_3$ or X.

6. A silver halide color photographic material as claimed in claim 5, wherein X represents a hydrogen atom, a chlorine atom, an alkoxy group or an alkylthio group.

7. A silver halide color photographic material as claimed in claim 5, wherein $R_3$ represents a group of formula (C-1):

$$R_7(Y)_m- \qquad \text{(C-1)}$$

wherein Y represents >NH, >CO or $>SO_2$, m represents an integer of 0 or 1, and $R_7$ represents a hydrogen atom, an alkyl group having from 1 to 30 carbon atoms, an aryl group having from 6 to 30 carbon atoms, a heterocyclic group having from 2 to 30 carbon atoms, $—COR_8$,

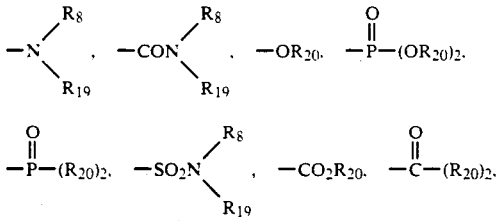

$—SO_2OR_{20}$ or $—SO_2R_{20}$ wherein $R_8$ and $R_{19}$, which may be the same or different, each represents a hydrogen atom, an alkyl group, an aryl group or a heterocyclic group, and $R_{20}$ represents an alkyl group, an aryl group or a heterocyclic group.

8. A silver halide color photographic material as claimed in claim 5, wherein the cyan coupler residual group Cp is represented by the following general formulas (Cp-1), (Cp-2), or (Cp-3):

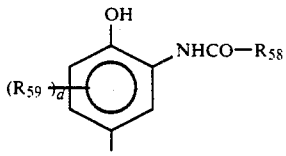

(Cp-1)

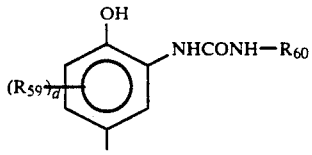

(Cp-2)

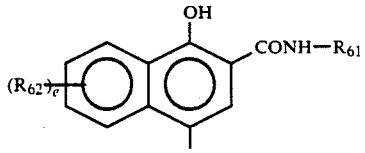

(Cp-3)

wherein $R_{41}$ represents an aliphatic group, an aromatic group or a heterocyclic group, $R_{42}$ represents an aromatic group or a heterocyclic group, and $R_{43}$, $R_{44}$ and $R_{45}$ represents independently a hydrogen atom, an aliphatic group, an aromatic group or a heterocyclic group;

$R_{58}$ represents an $R_{41}$- group;

$R_{59}$ represents an $R_{41}$- group, an $R_{41}CON(R_{43})$— group, an $R_{41}OCON(R_{43})$— group, an $R_{41}SO_2N(R_{43})$— group, an $—R_{43}NCON(R_{44})(R_{45})$— group, and $R_{41}O$- group, and $R_{42}S$- group, a halogen atom or an $R_{41}N(R_{43})$— group;

d represents an integer of from 0 to 3, and when d is 2 or 3, the plurality of $R_{59}$ groups may be the same or different, and may be joined with a divalent group to form a ring structure;

$R_{60}$ and $R_{61}$ each represents an $R_{41}$- group;

$R_{62}$ represents an $R_{41}$- group, an $R_{41}CONH$- group, an $R_{41}OCONH$-group, an $R_{41}SO_2NH$- group, an $R_{43}NCON(R_{44})(R_{45})$— group, an $R_{43}NSO_2N(R_{44})(R_{45})$— group, an $R_{43}O$- group, an $R_{41}S$- group, a halogen atom or an $R_{41}N(R_{43})$— group;

and e represents an integer of from 0 to 4, provided that, when there is a plurality of $R_{62}$ groups, these groups may be the same or different.

9. A silver halide color photographic material as claimed in claim 5, wherein the timing group T is represented by the following general formulas (T-1), (T-2), (T-3), (T-4), (T-5), or (T-6):

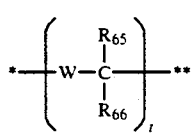

(T-1)

*-Nu-Link-E—** (T-2)

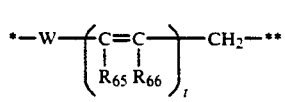

(T-3)

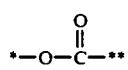

(T-4)

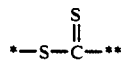

(T-5)

-continued

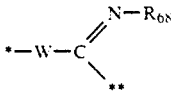

(T-6)

wherein W represents an oxygen atom, a sulfur atom or an

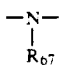

group, $R_{65}$ and $R_{66}$ represents hydrogen atoms or substituent groups, $R_{67}$ represents a substituent group, and t represents 1 or 2, provided that when t is 2, the two

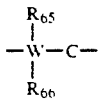

groups may be the same or different;

Nu represents a nucleophilic group; E represents an electrophilic group; and Link is a linking group enabling Nu and E to have a steric arrangement such that an intramolecular nucleophilic substitution reaction can occur;

and $R_{68}$ represents an $R_{67}$ group.

10. A silver halide color photographic material as claimed in claim 5, wherein the divalent linking group x is represented by the following general formula (II):

$$*\text{-}X_1\text{-}(L\text{-}X_2)_m\text{-}^{**} \qquad \text{(II)}$$

wherein * signifies the position which is bonded to $(T)_k$, ** signifies the position which is bonded to Q, $X_1$ represents —O— or —S—, L represents an alkylene group, $X_2$ represents a single bond, —O—, —S—, —CO—, $—SO_2—$

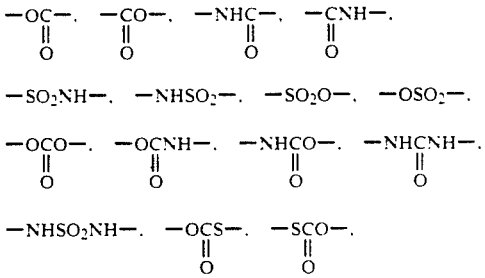

$—OSO_2NH—$ or $—NHSO_2O—$, and m represents an integer of from 0 to 3.

* * * * *